US005677096A

United States Patent [19]

Suzuki

[11] Patent Number: 5,677,096

[45] Date of Patent: Oct. 14, 1997

[54] ELECTROPHOTOGRAPHIC PHOTOCONDUCTOR

[75] Inventor: Yasuo Suzuki, Fuji, Japan

[73] Assignee: Ricoh Company, Ltd., Tokyo, Japan

[21] Appl. No.: 716,525

[22] Filed: Sep. 19, 1996

[30] Foreign Application Priority Data

Sep. 19, 1995 [JP] Japan ..... 7-264992

[51] Int. Cl.[6] ..... G03G 5/14

[52] U.S. Cl. ..... 430/59; 430/60; 430/78; 430/96

[58] Field of Search ..... 430/59, 60, 96

[56] References Cited

U.S. PATENT DOCUMENTS

| | | | |
|---|---|---|---|
| H1474 | 8/1995 | Martin et al. | 430/78 |
| 5,368,976 | 11/1994 | Tajima et al. | 430/176 |
| 5,587,262 | 12/1996 | Pinkney et al. | 430/78 |

FOREIGN PATENT DOCUMENTS

| | | |
|---|---|---|
| 564168 | 10/1993 | European Pat. Off. . |
| 57-062047 | 4/1982 | Japan . |
| 58-054335 | 3/1983 | Japan . |
| 3178986 | 8/1991 | Japan . |
| 4369653 | 12/1992 | Japan . |

*Primary Examiner*—John Goodrow
*Attorney, Agent, or Firm*—Oblon, Spivak, McClelland, Maier & Neustadt, P.C.

[57] ABSTRACT

An electrophotographic photoconductor, having an electrically conductive supporting substrate, an intermediate layer disposed thereon, a charge generation layer disposed on the intermediate layer, and a charge transport layer disposed on the charge generation layer, wherein the charge generation layer comprises particular titanyl phthalocyanine pigments dispersed in a particular binder resin, is provided which has improved photosensitivity and durability and is readily used for an analogue or digital photocopying machine, laser printer and laser facsimile apparatus.

20 Claims, 2 Drawing Sheets

ELECTROPHOTOGRAPHIC PHOTOCONDUCTOR

BACKGROUND OF THE INVENTION

1. Field of the Invention

The present invention relates to an electrophotographic photoconductor having a photoconductive layer comprising particular titanyl phthalocyanine pigments dispersed in a particular binder resin, which has improved electrophotographic properties, useful for an analogue or digital photocopying machine, laser printer and laser facsimile apparatus.

2. Discussion of the Background

Electrophotographic imaging systems are well known. A photoreceptor or photoconductor is generally used, on which is formed an electrostatic latent image. This photoconductor is made of an electrically conductive supporting substrate and contains on its surface a layer of a photoconductive material.

In electrophotography the surface of the photoconductive layer is initially charged in the dark with an electrostatic charge of a first polarity such as by corona charging. The surface is then exposed imagewise to light to selectively dissipate the charge from the exposed areas and form electrostatic latent images. Subsequently, the latent images are developed into visible images with toner particles made of a coloring agent, such as a dye or pigment, and a binder agent.

Examples of known useful photoconductive materials include inorganic photoconductive materials, such as selenium or alloys of selenium, cadmium sulfide or zinc oxide, dispersed in a binder agent. However, these inorganic photoconductors have shortcomings, such as insufficient photosensitivity, thermal instability, and toxic nature.

In order to overcome these shortcomings, there have been conducted numerous development activities on organic photoconductors for its advantageous properties, such as low cost, mass producible, non-toxic, and wider range of materials selection. In addition, there has been proposed a functionally-separated type photoconductive layer, comprising a charge generation layer and a charge transport layer, for which improvement in photosensitivity and durability can be expected.

In the field of electrophotography, there continues to be demands for images reproduced in higher quality and also for reproduction machines having the capability of editing and more complex data processing, for example. In compliance with these developments, digital equipment becomes more widely used as laser printers, laser facsimiles, and digital photocopying machines.

As a light source for a digital copying machine, a semiconductor laser diode is widely used for its compactness, low cost, and easy handling. Since the wavelength of the emission from the laser diode is practically limited to about 750 nm or above in the near infrared region, photoconductors for use in the above-mentioned equipment are required to be photosensitive to the wavelength up to from 750 and 850 nm, at least, to efficiently utilize light beams from the laser diodes.

As the organic photoconductors to meet the above requirement, there are known a squaric pigment, a phthalocyanine pigment, a complex of pyrylium dye with polycarbonate, pyrrolopyrrol pigment, and azo pigments. Since phthalocyanine pigments have photosensitivity at relatively long wavelengths compared to other organic photoconductors and also may have various modifications in molecular structure, many development efforts have concentrated on these organic photoconducting compounds.

There have been known as examples of phthalocyanine pigments having reasonable sensitivity for use as electrophotographic photoconductors, such as ϵ-type copper phthalocyanine, x-type metal-free phthalocyanine, τ-type metal-free phthalocyanine, vanadyl phthalocyanine, and titanyl phthalocyanine. However, these phthalocyanine pigments are not satisfactory with respect to properties, such as photosensitivity, charging capability, and durability for repeated imaging cycles. Therefore, there continues to be a demand for further improvements in these properties. As attempts for a higher sensitivity, high sensitive titanyl phthalocyanine pigments are disclosed in Japanese Laid-Open Patent Applications Nos. 64-17066 and H2-28265.

The above-mentioned titanyl phthalocyanine pigments exhibit main peaks of x-ray diffraction at the Bragg angles $2\theta=9.6°\pm0.2°$ and $27.2°\pm0.2°$ with the Cu Kα characteristic radiation (1.54 A), which are different from those known for previously reported titanyl phthalocyanine pigments. In addition, the titanyl phthalocyanine pigments have their optical absorption maxima at from 780 to 860 nm and can, therefore, exhibit high spectral sensitivity for light beams from a laser diode.

The titanyl phthalocyanine pigments have disadvantages, however, such as (1) although they are satisfactory in photosensitivity, they are electrically low resistant, resulting in relatively low charging capability, and are not satisfactory with durability for imaging cycles, (2) the pigments contain crystalline water and are adversely affected with relative ease by environmental conditions, (3) although not attributed entirely to the pigment property alone, there still exist problems such as dirty background in inversion development, and imaging defects like black spots, and (4) adhesion is not strong enough, thus resulting in peeling off between the charge generation layer and the supporting substrate or the intermediate layer.

Although the titanyl phthalocyanine possesses high sensitivity, as disclosed in Japanese Laid-Open Patent Applications Nos. 64-17066 and H2-28265, there continues to be a need to obviate the above problems, such as relatively low charging capability and durability, dirty background in inversion developing, and imaging defects like black spots, electrostatic characteristics being adversely affected with relative ease by environmental conditions, and insufficient adhesion.

In order to solve these problems, there are disclosed an intermediate layer provided between the conductive supporting substrate and the photoconductor, made of resin material, such as alkoxymethylated nylon (Japanese Laid-Open Patent Application No. H3-248161), thermosetting resin (Japanese Laid-Open Patent Applications No. H3-33856), resin which is hardly soluble or insoluble in alcohols (Japanese Laid-Open Patent Applications No. H3-37669), organic pigments and/or inorganic pigments (Japanese Laid-Open Patent Applications No. H3-33858), and block isocyanate compounds (Japanese Laid-Open Patent Applications Nos. H3-33857).

These disclosed photoconductors have not been able to solve the above-mentioned problems. Even if some of these photoconductors have photosensitivity to a certain degree, they still have problems of decreased sensitivity during repeated usage. In addition, no attempts have been made regarding improvement of durability under various environmental conditions.

SUMMARY OF THE INVENTION

Accordingly, one object of the present invention is to provide an electrophotographic photoconductor which overcomes the above-noted difficulties.

A further object of the present invention is to provide an electrophotographic photoconductor, comprising an electrically conductive supporting substrate, an intermediate layer disposed thereon, a charge generation layer disposed on said intermediate layer, and a charge transport layer disposed on the charge generation layer, wherein the charge generation layer comprises titanyl phthalocyanine pigments dispersed in a binder resin with specified materials property, which has improved photosensitivity and durability and is readily used for an analogue or digital photocopying machine, laser printer and laser facsimile apparatus.

These and other objects of the present invention have been satisfied by the discovery of an electrophotographic photoconductor, comprising a conductive supporting substrate, an intermediate layer disposed thereon, a charge generation layer disposed on the intermediate layer, and a charge transport layer disposed on the charge generation layer, the charge generation layer comprising titanyl phthalocyanine pigments dispersed in a binder resin, wherein the titanyl phthalocyanine pigments preferably exhibit main peaks of x-ray diffraction at least at the Bragg angles $2\theta=9.6°\pm0.2°$ and $27.2°\pm0.2°$ with the CuKα characteristic radiation (1.54 A) and the binder resin has 33 mole % or more of hydroxy group, and wherein the intermediate layer comprises titanium dioxide and another binder resin, the titanium dioxide having a purity of 99.2% or greater by weight.

According to an alternative embodiment, the binder resin, having 33 mole % or more of hydroxy group, comprises butyral resin. "Butyral resin", as used herein, means such resin containing residual hydroxy groups after polymerization.

In another embodiment, the charge transport layer comprises an aminobiphenyl derivative of the formula (I):

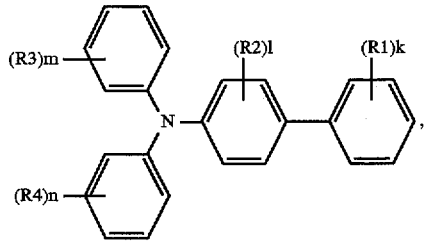

(I)

where R1, R3 and R4 each is hydrogen, an amino group, an alkoxy group, a thioalkoxy group, an aryloxy group, a methylenedioxy group, a substituted or unsubstituted alkyl group, halogen, or a substituted or unsubstituted aryl group; and R2 is hydrogen, an alkoxy group, a substituted or unsubstituted alkyl group, or halogen; R1 and R2 may form a ring compound in combination except where all of R1, R2, R3 and R4 are hydrogen; k,l,m and n each is an integer from 1 to 4; and when k,l,m and n each is 2, 3 or 4, R1,R2,R3 or R4 may be either the same or different.

In yet another embodiment, said charge transport layer comprises a stilbene compound of the formula (II):

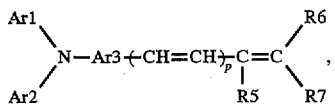

(II)

where Ar1 or Ar2 is a substituted or unsubstituted aryl group or a substituted or unsubstituted heterocyclic group; R5, R6 and R7 each is hydrogen, a substituted or unsubstituted alkyl group, a substituted or unsubstituted alkoxy group, a substituted or unsubstituted aryl group, or a substituted or unsubstituted heterocyclic group; R6 and R7 may form a ring in combination; Ar3 is a substituted or unsubstituted arylene group, and p is an integer of either 0 or 1.

These and other objects, features and advantages of the present invention will become apparent upon a consideration of the following description of the preferred embodiments of the present invention taken in conjunction with the accompanying drawings.

DESCRIPTION OF THE PREFERRED EMBODIMENTS

Figure 1:
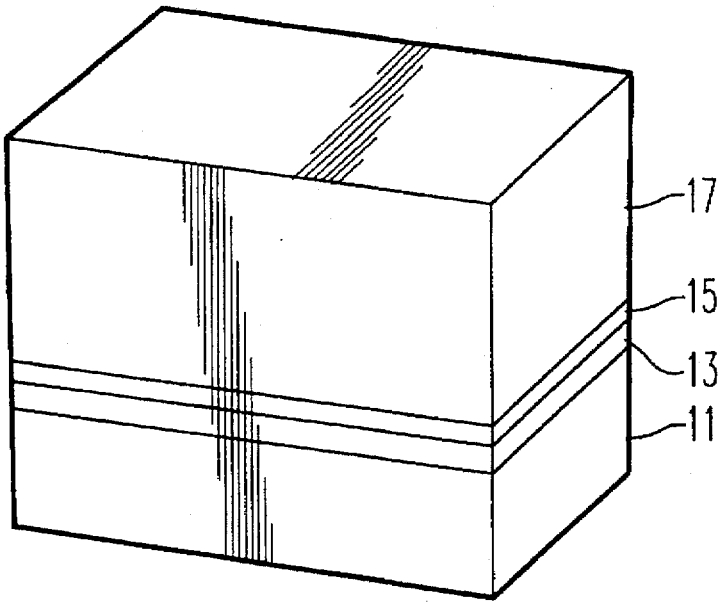
FIG. 1 is a partially cross sectional view of an electrophotographic photoconductor of the present invention.

In the detailed description which follows, embodiments of the invention particularly useful in the electrophotographic applications are described. It is understood, however, that the invention is not limited to these embodiments. For example, it is appreciated that the photoconductors and methods of the invention are adaptable to any form of electrophotographic imaging. Other embodiments will be apparent to those skilled in the art upon reading the following description.

The invention provides an electrophotographic photoconductor, comprising an electrically conducting supporting substrate, an intermediate layer disposed thereon, a charge generation layer disposed on the intermediate layer, and a charge transport layer disposed on the charge generation layer. In the present invention, (1) the charge generation layer comprises titanyl phthalocyanine pigments dispersed in a binder resin, the titanyl phthalocyanine pigments preferably exhibiting main peaks of x-ray diffraction at least at the Bragg angles $2\theta=9.6°\pm0.2°$ and $27.2°\pm0.2°$ with the Cu Kα characteristic radiation (1.54 A) and the binder resin having 33 mole % or more of hydroxy group and (2) the intermediate layer comprises titanium dioxide and another binder resin, the titanium dioxide having a purity of 99.2% or greater by weight.

The molecular structure for titanyl phthalocyanine pigments is expressed by the following formula:

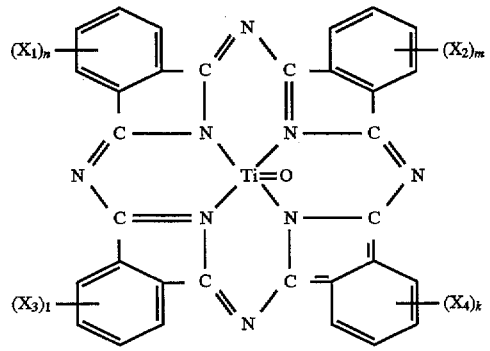

where $X_1$, $X_2$, $X_3$ and $X_4$ each is a halogen atom and n,m,l, and k each represents an integer.

Titanyl phthalocyanine pigment for use in the invention is formed as an aggregate of crystals of the above-mentioned phthalocyanine molecules, which exhibits x-ray diffraction peaks characteristic to the titanyl phthalocyanine structure. The titanyl phthalocyanine pigments with the structure specified as above have its optical absorption from 780 to 860 nm of the visible and near infrared region and the pigments of this type of phthalocyanine structure also exhibit high photosensitivity to the wavelength of the emission from laser diodes compared with titanyl phthalocyanine pigments having other types of crystal structure.

Methods for synthesizing the titanyl phthalocyanine pigments are described in afore-mentioned disclosures, Japanese Laid-Open Patent Applications Nos. 64-17066 and H2-28266.

In the intermediate layer in this invention there are included titanium dioxide particles. The particles do not exhibit any significant optical absorption in the visible and near infrared region, which is preferable for higher photosensitivity and the particles also have a large refractive index, effectively preventing the appearance of moire patterns during image writing by means of coherent light beams from the laser diode.

In addition, the titanium dioxide particles are preferably of a purity of 99.2% or more by weight in the present invention. Possible impurities in titanium dioxide particles are substances such as $Na_2O$ and $K_2O$, for example, which are ionic and moisture absorbent. For a purity of less than above indicated, there may result a large change in photoconductor characteristics due to environmental conditions such as humidity, for example, during imaging cycles. These impurities may also give rise to defects in reproduced images such as black spots.

In the intermediate layer, there is also included melamine resin together with the titanium dioxide particles. The melamine resin is thermosetting and, once hardened, the resin cannot be dissolved by solvents used for coating the overlying charge generation or charge transport layer, thus preventing problems such as possible damage to the intermediate layer. In addition, the melamine resin has excellent solubility for titanium dioxide particles even as its primary particle, thus resulting in satisfactory coating without minute protrusions or voids, which are considered to be caused by non-dispersed particles.

As the melamine resin for use in the present invention, conventionally available melamine resins can be employed and preferably the alkyl etherified type of melamine resin is preferred for a desirable effect on the stability of coating composition, and the resin having a acid value of less than or equal to 1 is more preferably employed for its effect on electrostatic characteristics.

In addition, the titanium dioxide (P) and the binder resin (R) are included in the intermediate layer such that the volume ratio P/R is preferably from 0.9/1 to 2/1. For a P/R value of less than 0.9/1, the property of the intermediate layer is largely affected by the property of the binder resin, possibly resulting in relatively large change in photoconductor characteristics due to moisture, for example, during imaging cycles. For a P/R value of greater than 2/1, there results a number of voids in the intermediate layer, resulting in reduced adhesion between the intermediate layer and the charge generation layer. For a P/R value of larger than 3/1, air is contained in the layer and may result in air bubbles and/or various coating defects during the coating process.

In the present invention, a resin having 33 mole % or more of hydroxy group is preferably employed as the binder for the charge generation layer, wherein the amount of hydroxy group is the amount of polyvinyl alcohol component or hydroxy group to the total amount of resins in said layer. As the above-mentioned resin in the present invention, there is preferably employed polyvinyl alcohol, vinylacetate resin, polyvinylformal, butyral resin, polyvinyl ether, and cellulose resins. By using resins having 33 mole % or greater of hydroxy group together with the titanyl phthalocyanine pigments, there are achieved excellent dispersion of the titanyl phthalocyanine pigments in the coating composition and preparation of a stable coating composition to fabricate photoconductors with durable and stable photosensitivity, thus capable of fabricating photoconductors having an improved electrophotographic property and environmental stability.

Of the above resins for use as binder for the charge generation layer, butyral resin is more preferably employed to further improve the above-mentioned properties and adhesion between the layers.

Using the above-mentioned materials and construction of the present invention, some of the improvements in photoconductor properties are as follows.

(1) By using the highly photosensitive titanyl phthalocyanine pigments, a photoconductor having sufficient photosensitivity to the light of relatively long wavelength can be obtained, being operable with a semiconductor laser diode and being suitable for electrophotographic equipment, such as photocopying machine, printer, and facsimile.

(2) By providing the intermediate layer, problems such as image defects or dirty background, black spots, especially in the reversal development process can be obviated. This improvement is believed to be due to the following reasons. The binder resin together with titanium dioxide particles exhibit an excellent property of blocking the hole injection. A homogeneously coated film with a highly flat surface can be obtained because of the satisfactory dispersion capability of melamine resin for titanium dioxide particles, thus reducing defects caused by the coating process, such as minute protrusions, for example, which may cause black spots.

(3) Similarly by the use of the intermediate layer, electrophotographic photoconductors having electrostatic characteristics, such as reduction in the magnitude of decrease in charging during imaging cycles and also reduction in the increase in the residual potential can be achieved, thus resulting in improved durability. This is considered due to the fact that, as above-mentioned, the intermediate layer exhibits an excellent property of blocking the hole injection. In addition, because of the satisfactory dispersion capability of binder resin for titanyl phthalocyanine pigments of the present invention, the charge generation layer can be formed thin enough to acquire satisfactory electrostatic characteristics, since charging capability of the phthalocyanine pigments generally decreases with increasing film thickness.

(4) The electrophotographic photoconductor having improved durability of the electrostatic characteristics under various environmental conditions is achieved by the provision of the intermediate layer of the present invention. The reasons for the intermediate layer is believed that there are used less moisture absorbing material, such as titanium dioxide and thermosetting resin. In addition, the resin having 33 mole % or more of hydroxy group, effectively interacts with the titanyl phthalocyanine pigments which contain water of crystallization, to exist in coated films to be less affected by the environmental conditions.

(5) The electrophotographic photoconductor may be formed with excellent adhesion among the layers in the photoconductor. Also a photoconductor with reduced coating defects is provided by taking advantage of the physical and chemical interaction between melamine resin and hydroxy groups of the binder resin in the charge generation layer, thus preventing peeling off between the intermediate layer and the charge generation layer. In addition, the adhesion is further improved by homogeneity and flatness of the coated films.

The amount of hydroxy group in the binder resin in the charge generation layer can be determined by measuring infrared absorption spectra. The measurement method of the hydroxy group in vinyl butyral resin (i.e. polyvinyl butyral) is as follows:

Measurement Method of Hydroxy Group Amount (1) A solvent of 150 ml of ethanol mixed with toluene (weight ratio 1:1) is prepared in an Erlenmeyer flask. Resin material is weighed and added into the solvent so as to have a concentration of the resin in solution of 10±0.1 weight %. The resultant solution is stirred to dissolve for at least 3 hours in a room with its temperature controlled at 20° C. and then spread on a sheet of polyethylene.

(2) After it is air-dried, the sheet prepared as above is subjected to vacuum drying for at least 5 hours under a pressure of 710 mm Hg or below at 20° C. temperature to obtain a sample film. The thickness of the sample film is preferably from 10 to 20 microns such that the percent transmission of the film at 2980 $cm^{-1}$ $CH_2$ asymmetric vibration frequency is from 10 to 45.

(3) The prepared sample film is peeled off from the sheet of polyethylene and IR absorption measurement of the film is carried out with an EPI-G3 infrared spectrometer from Hitachi Co.

(4) The amount of hydroxy groups and residual acetyl groups is obtained according to a calibration curve previously prepared as follows: After the testing method of polyvinyl butyral defined by JIS K6728, the amount of vinyl alcohol is obtained by weight % at first and then converted to mole %. The amounts obtained are shown with the mole % of vinyl alcohol and vinyl acetate as the x coordinate axis and the percent transmission values as the y coordinate in the calibration curve.

Calculation Method (1) A baseline is drawn through the following two points on the IR absorption spectrum: One is the maximum in the region from 3900 to 2300 $cm^{-1}$ and the other is the minimum in the region of from 1900 to 1600 $cm^{-1}$.

(2) Extinction coefficients $D=\log(I_0/I)$ are obtained for IR absorptions, for 3500 $cm^{-1}$ as D(OH), for 2980 $cm^{-1}$ as D($CH_2$ asymmetric vibration), for 2900 $cm^{-1}$ as D($CH_2$ symmetric vibration), and for 1740 $cm^{-1}$ as D(CO).

(3) Following ratios are calculated:

D(OH)/D($CH_2$ asymmetric vibration),

D(OH)/D($CH_2$ symmetric vibration),

D(CO)/D($CH_2$ asymmetric vibration), and

D(CO)/D($CH_2$ symmetric vibration).

The amount of hydroxy groups and residual acetyl groups is obtained according to a calibration curve as follows.

$$\text{Hydroxy group(mole \%)} = 84.974 \times D(\text{OH})/D(\text{CH}_2\text{ asymmetric vibration}) + 6.45 \quad \text{(i)}$$

$$= 64.851 \times D(\text{OH})/D(\text{CH}_2\text{ symmetric vibration}) + 3.63. \quad \text{(ii)}$$

The amount of the hydroxy group is obtained as the average of (i) and (ii).

$$\text{Residual acetyl groups(mole \%)} = 18.87 \times D(\text{CO})/D(\text{CH}_2\text{ asymmetric vibration}) \quad \text{(iii)}$$

$$= 12.48 \times D(\text{CO})/D(\text{CH}_2\text{ symmetric vibration}). \quad \text{(iv)}$$

The amount of the acetyl groups is obtained as the average of (iii) and (iv).

Degree of butylation(mole %) =

100 − (amount of hydroxy group + amount of acetyl group).

The purity of the titanium dioxide particles for use in the present invention is determined by the method defined by JIS K5116.

Referring to the drawings, the invention will be described.

Illustrated in FIG. 1 is a partially cross sectional view of an electrophotographic photoconductor of the present invention, comprising an electrically conductive supporting substrate 11, an intermediate layer 13 disposed thereon, a charge generation layer 15 disposed on the intermediate layer, and a charge transport layer 17 disposed on the charge generation layer.

Figure 2:
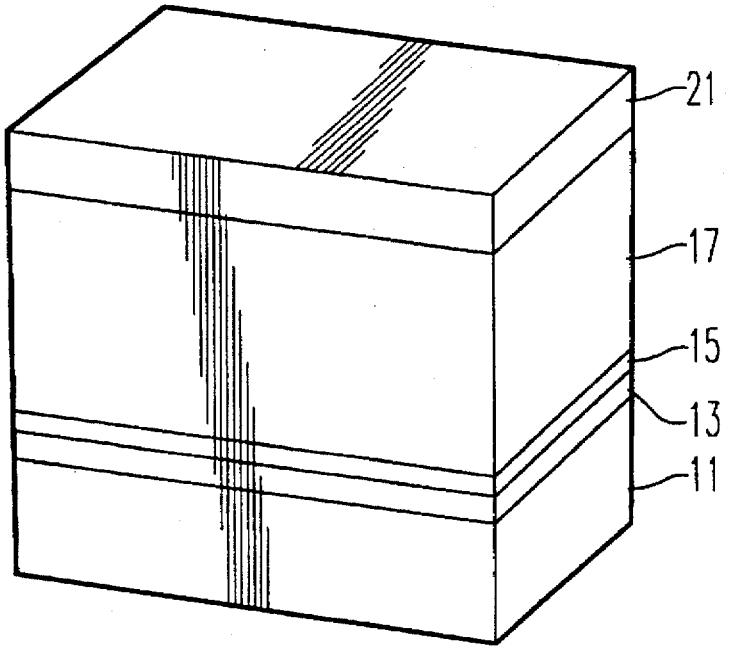
FIG. 2 is a partially cross sectional view of another electrophotographic photoconductor of the present invention.

Illustrated in FIG. 2 is another example of the electrophotographic photoconductor of the present invention, comprising a conductive supporting substrate 11, an intermediate layer 13 disposed thereon, a charge generation layer 15 disposed on the intermediate layer, a charge transport layer 17 disposed on the charge generation layer, and a protective layer 21 provided on the charge transport layer.

As materials for the conductive supporting substrate in the present invention, various conducting materials or materials which are rendered conductive by treatment, having a volume resistivity of $10^{10}$ ohm.cm or less, can be employed. The conductive supporting substrate can be prepared by coating a plastic film or a sheet of paper, which may be in the form of a cylinder, with metals such as aluminum, nickel, chromium, nichrom, copper, gold and silver; or metallic oxides such as tin oxide or indium oxide by the vacuum deposition method or sputter deposition method. Alternatively, a sheet of aluminum, aluminum alloys, nickel, or stainless steel, formed into a tube by extrusion or drawing and subsequently being subjected to surface finish such as machining and abrasion, may be employed. In addition, the substrate may have any different configuration, such as, for example, an endless flexible nickel or stainless steel belt as disclosed in Japanese Laid-Open Patent Application 52-36016.

Furthermore, a conductive layer with conductive particles dispersed in a binder resin, provided on the above-mentioned substrate, may also be employed as the supporting substrate of the present invention. Examples of the conductive particles include pulverized powder of carbon black, acetylene black, and metals such as aluminum, nickel, iron, nichrom, copper, zinc, and silver; and metallic oxide such as conductive titanium dioxide, tin oxide, and indium tin oxide.

Examples of the binder resin in which the conductive particles are dispersed include thermoplastic resins, thermosetting resins, or photo hardening resins such as polystyrene, styrene-acrylonitrile copolymer, styrene-butadiene copolymer, styrene-maleic anhydride copolymer, polyester, polyvinylchloride, vinylchloride-vinylacetate copolymer, polyvinyl acetate, polyvinylidene chloride, polyacrylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenolic resin, and alkyd resin.

The above-mentioned conductive particles and the binder resin are dissolved in an appropriate solvent such as tetrahydrofuran, dichloromethane, methyl ethyl ketone or toluene, to prepare a coating composition for the supporting substrate. The thus prepared coating composition is then disposed on an aforementioned substrate to form a conductive supporting substrate of the present invention.

In addition, conductive material can be prepared by dispersing the above-mentioned conductive particles into resin material such as polyvinyl chloride, polypropylene, polyester, polystyrene, polyvinylidene chloride, polyethylene, chlorinated rubber or Teflon. This heat-shrinkable conductive material is then provided on a suitable cylindrical substrate to form the conductive supporting substrate.

The charge generation layer 15 of the present invention comprises titanyl phthalocyanine pigments dispersed in a binder resin, as aforementioned. The charge generation layer can therefore be formed by (1) mixing the titanyl phthalocyanine pigments and the binder resin and dispersing them in a suitable solvent to prepare a coating composition with a ball mill, attritor, sand mill, or ultrasonic disperser, and (2) disposing the coating composition on the intermediate layer 13 and drying to form the charge generation layer.

Suitable binder resins for use in the charge generation layer include resins having 33 mole % or more of hydroxy group such as butyral resin, polyvinyl formal, polyvinyl benzal, polyvinyl acetate, cellulose resin, polyvinyl alcohol and polyvinyl ether.

Of these resins, butyral resin is preferably used for its effect on the photosensitivity, the reason for which is not entirely clear. However, it is considered to be attributed to its excellent capability of adhesion and dispersion, for the titanyl phthalocyanine pigments.

The amount of the binder resin used for the charge generation layer is preferably from 10 to 300 parts by weight and more preferably from 20 to 200 parts by weight, to 100 parts by weight of the charge generation material.

The thickness of the charge generation layer is preferably from 0.02 to 3 microns and more preferably from 0.1 to 2 microns.

Suitable solvents for use for the charge generation layer in the present invention include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, and ligroine.

The coating composition for the charge generation layer may be disposed by dip coating, spray coating, beads coating, nozzle coating, spinner coating, or ring coating.

The charge transport layer of the present invention can be fabricated by dissolving a charge transport material and binder resin into an appropriate solvent to prepare a coating composition and then coating the composition onto the charge generation layer and drying the coated layer. In addition to the above-mentioned materials, plasticizers, leveling agents and/or antioxidants may further be included, if desired.

The charge transport material is broadly divided into a positive hole transport material and an electron transport material.

Examples of the electron transporting material include but are not limited to electron acceptors such as chloroanil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno(1,2-b)thiophene-4-on, 1,3,7-trinitrodibenzothiophene-5,5-dioxide, and benzoquinone derivatives.

Examples of the positive hole transporting materials suitable for the present invention include but are not limited to poly-N-vinylcarbazole and its derivatives, poly-γ-carbazolylethylglutamate and its derivatives, pyreneformaldehyde condensation product and its derivatives, polyvinyl pyrene, polyvinyl phenanthrene, polysilane, oxazole derivatives, imidazol derivatives, monoarylamine derivatives, diarylaminne derivatives, triarylamine derivatives, stilbene derivatives, α-phenylstilbene derivatives, benzidine derivatives, diarylmethane derivatives, triarylmethane derivatives, 9-styryl-anthracene derivatives, pyrazoline derivatives, divinylbenzene derivatives, hydrazone derivatives, indene derivatives, butadiene derivatives, pyrene derivatives, bisstilbene derivatives, enamine derivatives, and aminobiphenyl derivatives.

These charge transporting materials may be used singly or in combination.

Of these charge transporting materials, aminobiphenyl compounds and stilbene compounds are preferably employed in the present invention as shown in formulas (I) and (II), respectively:

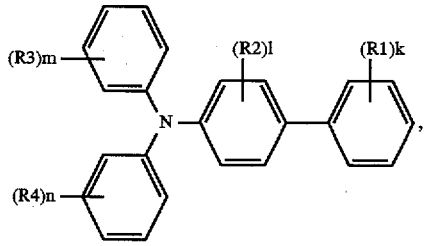

(I)

where R1, R3 and R4 each is hydrogen, an amino group, an alkoxy group, a thioalkoxy group, an aryloxy group, a methylenedioxy group, a substituted or unsubstituted alkyl group, halogen, or a substituted or unsubstituted aryl group; and R2 is hydrogen, an alkoxy group, a substituted or unsubstituted alkyl group, or halogen; R1 and R2 may form a ring compound in combination except where all of R1, R2, R3 and R4 are hydrogen; k,l,m and n each is an integer from 1 to 4; and when k,l,m and n each is 2, 3 or 4, R1,R2,R3 or R4 may be either the same or different;

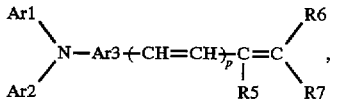

(II)

where Ar1 or Ar2 is a substituted or unsubstituted aryl group or a substituted or unsubstituted heterocyclic group; R5, R6 and R7 each is hydrogen, a substituted or unsubstituted alkyl group, a substituted or unsubstituted alkoxy group, a substituted or unsubstituted aryl group, or a substituted or unsubstituted heterocyclic group; R6 and R7 may form a ring in combination; Ar3 is a substituted or unsubstituted arylene group, and p is an integer of either 0 or 1.

Suitable examples of the aminobiphenyl compounds include but are not limited to those shown below, with reference to formula (I) above:

| Compound No. | R1 | R2 | R3 | R4 |
|---|---|---|---|---|
| 1 | H | H | 4-$C_6H_4CH_3$(P) | H |
| 2 | H | H | 4-$CH_3$ | 4-$CH_3$ |
| 3 | H | H | 3-$CH_3$ | 3-$CH_3$ |
| 4 | H | H | 2-$CH_3$ | 2-$CH_3$ |
| 6 | H | H | 4-$CH_3$ | H |
| 6 | H | H | 4-$C_2H_5$ | 4-$C_2H_5$ |
| 7 | H | H | 4-$C_2H_5$ | H |
| 8 | H | H | 4-$OCH_3$ | 4-$OCH_3$ |
| 9 | H | H | 3-$OCH_3$ | 3-$OCH_3$ |
| 10 | H | H | 2-$OCH_3$ | 2-$OCH_3$ |
| 11 | H | H | 4-$OCH_3$ | H |
| 12 | H | H | 4-$OCH_3$ | 4-$CH_3$ |
| 13 | H | H | 4-$OC_2H_5$ | H |
| 14 | H | H | 4-$iC_3H_7$ | 4-$iC_3H_7$ |
| 15 | H | H | 4-$NEt_2$ | H |
| 16 | H | H | 4-$C_2H_5$ | H |
| 17 | H | H | 4-$C_2H_5$ | 4-$C_2H_5$ |
| 18 | H | H | 4-$CH_2C_2H_5$ | H |
| 19 | H | H | 4-Cl | H |
| 20 | 4-$CH_3$ | H | H | H |
| 21 | H | H | 4-$CH_3$ | 4-$CH_3$ |
| 22 | H | H | 3-$CH_3$ | 3-$CH_3$ |
| 23 | H | H | 2-$CH_3$ | 2-$CH_3$ |
| 24 | H | H | 4-$CH_3$ | H |
| 25 | H | H | 4-$C_2H_5$ | H |
| 26 | H | H | 4-$C_2H_5$ | 4-$C_2H_5$ |
| 27 | 4-$CH_3$ | H | 4-$OCH_3$ | 4-$OCH_3$ |
| 28 | " | H | 3-$OCH_3$ | 3-$OCH_3$ |
| 29 | " | H | 4-$OCH_3$ | H |
| 30 | " | H | 4-$OC_2H_5$ | H |
| 31 | " | H | 4-$NEt_2$ | H |
| 32 | " | H | 4-$C_2H_5$ | 4-$C_2H_5$ |
| 33 | " | H | 4-$C_2H_5$ | H |
| 34 | " | H | 3-Cl | H |
| 35 | 4-$C_2H_5$ | H | 4-$CH_3$ | 4-$CH_3$ |
| 36 | " | H | 4-$OCH_3$ | 4-$OCH_3$ |
| 37 | " | H | 3-$CH_3$ | H |
| 38 | " | H | 3-$CH_3$ | 3-$CH_3$ |
| 39 | 3-$CH_3$ | H | 4-$CH_3$ | 4-$CH_3$ |
| 40 | " | H | 3-$CH_3$ | 3-$CH_3$ |
| 41 | " | H | C—$CH_3$ | 2-$CH_3$ |
| 42 | " | H | H | H |
| 43 | H | 3$CH_3$ | 4-$CH_3$ | 4-$CH_3$ |
| 44 | H | " | 3-$CH_3$ | 3-$CH_3$ |
| 45 | H | 2-$CH_3$ | 4-$CH_3$ | 4-$CH_3$ |
| 46 | 4-$C_2H_5$ | H | H | H |
| 47 | 3-$CH_3$ | H | H | H |
| 48 | 2-$CH_3$ | H | H | H |
| 49 | " | H | 4-$CH_3$ | 4-$CH_3$ |
| 50 | " | H | 3-$CH_3$ | 3-$CH_3$ |
| 51 | H | H | 2,4-$(CH_3)_2$ | H |
| 52 | H | H | 3,4-$CH_2O_2$ | H |
| 53 | H | H | 4-$C_6H_5$ | 4-$C_6H_5$ |
| 54 | 4-$OCH_3$ | H | H | H |
| 55 | " | H | 4-$CH_3$ | H |
| 56 | " | H | 3-$CH_3$ | H |
| 57 | " | H | 4-$CH_3$ | 4-$CH_3$ |
| 58 | " | H | 4-$OCH_3$ | 3-$CH_3$ |
| 59 | " | H | 4-$OCH_3$ | H |
| 60 | " | H | 4-$OCH_3$ | 4-$CH_3$ |
| 61 | 4-$OC_6H_5$ | H | H | H |
| 62 | " | H | 4-$CH_3$ | 4-$CH_3$ |
| 63 | " | H | 3-$CH_3$ | 3-$CH_3$ |
| 64 | " | H | 4-$CH_3$ | H |
| 65 | 3-Cl | H | 4-$CH_3$ | 4-$CH_3$ |
| 66 | " | H | 4-$OCH_3$ | 4-$OCH_3$ |
| 67 | 3-$OC_3H_6$ | H | H | H |
| 68 | " | H | 4-$CH_3$ | 4-$CH_3$ |
| 69 | " | H | 3-$CH_3$ | 3-$CH_3$ |
| 70 | H | H | 4-n$C_3H_7$ | H |
| 71 | 4-n$C_3H_7$ | H | H | H |
| 72 | " | H | 4-$CH_3$ | 4-$CH_3$ |
| 73 | 4-n$C_6H_5$ | H | 4-n$C_3H_7$ | 4-n$C_3H_7$ |

-continued

| | | | | |
|---|---|---|---|---|
| 74 | 4-$SCH_2$ | H | H | H |
| 75 | 4-$SCH_2$ | H | 4-$CH_3$ | 4-$CH_3$ |
| 76 | H | H | 4-$SCH_3$ | 4-$SCH_3$ |
| 77 | H | H | 4-$SCH_3$ | H |
| 78 | H | H | 4-t$C_4H_9$ | 4-t$C_4H_9$ |
| 79 | H | H | 4-n$C_4H_9$ | 4-n$C_4H_9$ |
| 80 | 4-$CH_3C_6H_5$ | H | H | H |
| 81 | " | H | 4-$CH_3$ | 4-$CH_3$ |
| 82 | " | H | 4-$OCH_3$ | H |
| 83 | " | H | 3-$CH_3$ | 3-$CH_3$ |
| 84 | " | H | 2-$CH_3$ | 2-$CH_3$ |
| 85 | 4-$CH_3C_6H_6$ | H | 4-$OCH_3$ | 4-$OCH_3$ |
| 86 | " | H | 3-$OCH_3$ | 3-$OCH_3$ |
| 87 | 4-$CH_3$ | H | 4-$C_6H_4CH_3$(P) | H |
| 88 | " | H | 4-t$C_4H_9$ | 4-t$C_4H_9$ |
| 89 | " | H | 4-i$C_5H_7$ | 4-i$C_3H_7$ |
| 90 | 4-$C_2H_5$ | H | 4-$C_6H_4CH_3$(P) | H |
| 91 | " | H | 4-t$C_4H_9$ | 4-t$C_4H_9$ |
| 92 | " | H | 4-i$C_3H_7$ | 4-i$C_3H_7$ |
| 93 | 4-$OCH_3$ | H | 4-$C_6H_4CH_3$(P) | H |
| 94 | " | H | 4-t$C_4H_9$ | 4-t$C_4H_9$ |
| 95 | " | H | 4-i$C_3H_7$ | 4-i$C_3H_7$ |
| 96 | 4-t$C_4H_9$ | H | H | H |
| 97 | " | H | 4-$CH_3$ | 4-$CH_3$ |
| 98 | " | H | 3-$CH_3$ | 3-$CH_3$ |
| 99 | " | H | 2-$CH_3$ | 2-$CH_3$ |
| 100 | " | H | 4-$OCH_3$ | 4-$OCH_3$ |
| 101 | " | H | 4-$OCH_3$ | H |
| 102 | " | H | 4-t$C_4H_9$ | 4-t$C_4H_9$ |
| 103 | " | H | 4-i$C_3H_7$ | 4-i$C_3H_7$ |
| 104 | " | H | 4-$C_6H_4CH_3$(P) | H |
| 105 | 4-$OC_2H_5$ | H | 4-$CH_3$ | 4-$CH_3$ |
| 106 | " | H | 3-$CH_3$ | 3-$CH_3$ |
| 107 | " | H | 2-$CH_3$ | 2-$CH_3$ |
| 108 | " | H | 4-$OCH_3$ | 4-$OCH_3$ |
| 109 | " | H | 4-$OCH_3$ | H |
| 110 | " | H | 4-t$C_4H_9$ | 4-t$C_4H_9$ |
| 111 | 4-$OC_2H_5$ | H | 4-i$C_3H_7$ | 4-t$C_3H_7$ |
| 112 | " | H | 4-$C_6H_4CH_3$(P) | H |
| 113 | H | 3-$CH_3$ | 4-t$C_4H_9$ | 4-t$C_4H_9$ |
| 114 | H | 3-$CH_3$ | 4-$C_6H_4CH_3$(P) | H |
| 115 | H | 3-$OCH_3$ | 4-$CH_3$ | 4-$CH_3$ |
| 116 | H | " | 3-$CH_3$ | 3-$CH_3$ |
| 117 | H | " | 4-$OCH_3$ | 4-$OCH_3$ |
| 118 | H | " | 4-t$C_4H_9$ | 4-t$C_4H_9$ |
| 119 | H | " | 4-$C_6H_4CH_3$(P) | H |
| 120 | 4-$NH_2$ | H | 4-$CH_3$ | 4-$CH_3$ |
| 121 | 3-$CH_3$ | 3-$CH_3$ | 4-$CH_3$ | 4-$CH_3$ |
| 122 | " | " | 3-$CH_3$ | 3-$CH_3$ |
| 123 | " | " | 2-$CH_3$ | 2-$CH_3$ |
| 124 | " | " | 4-$OCH_3$ | 4-$OCH_3$ |
| 125 | H | " | 4-$OCH_3$ | 4-$OCH_2$ |

(I)-126

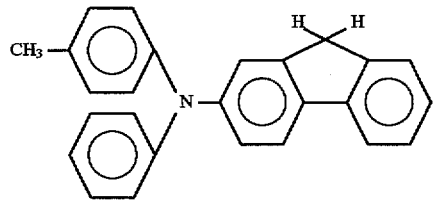

(I)-127

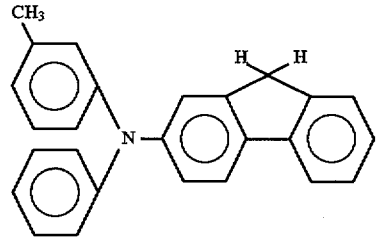

(I)-128
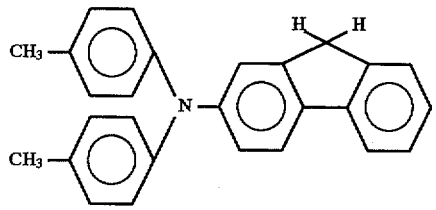
(I)-129
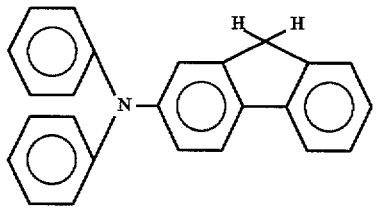
(I)-130
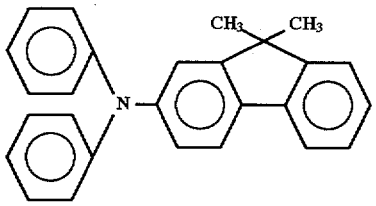
(I)-131
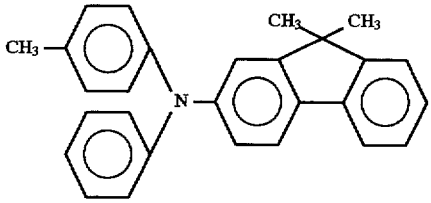
(I)-132
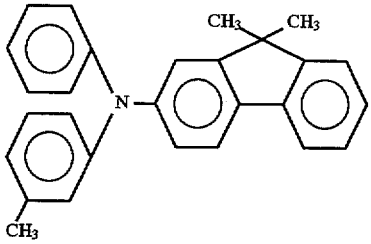
(I)-133
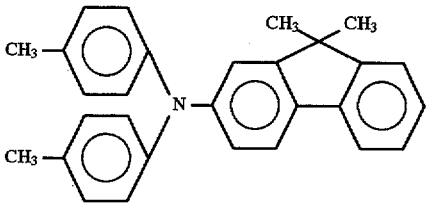
Suitable examples of the stilbene compounds include but are not limited to those shown below, with reference to formula (II) above:
(a) Specific examples for p=0.

| Compound No. | $Ar^1$ | $Ar^2$ | $Ar^3$ | $R^5$ | $R^6$ | $R^7$ |
|---|---|---|---|---|---|---|
| II-1 | 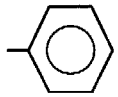 | 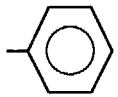 | 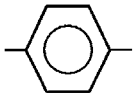 | −H | −H | 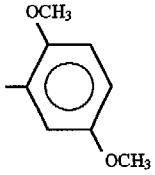  |
| II-2 | 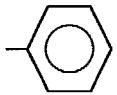 | 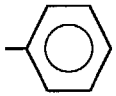 | 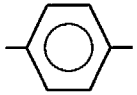 | −H | −H | 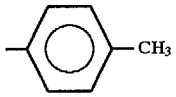  |
| II-3 | 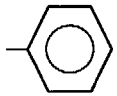 | 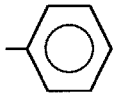 | 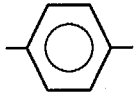 | −H | −H | 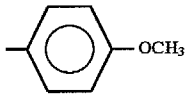  |
| II-4 | 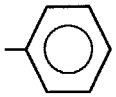 | 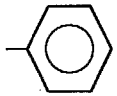 | 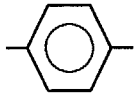 | −H | −H | 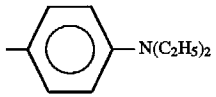  |
| II-5 | 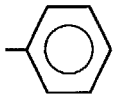 | 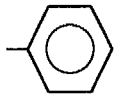 | 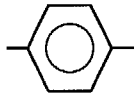 | −H | 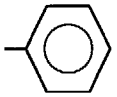 | 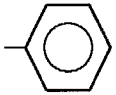 |
| II-6 | 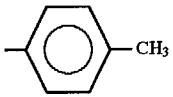  | 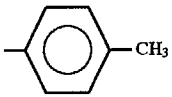  | 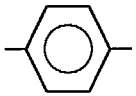 | −H | 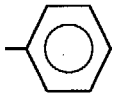 | 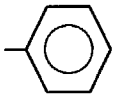 |
| II-7 | 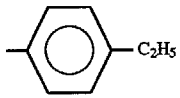  | 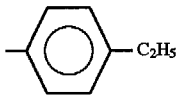  | 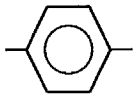 | −H | 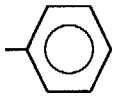 | 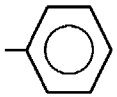 |
| II-8 | 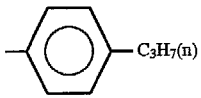  | 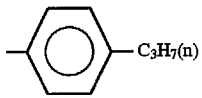  | 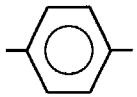 | −H | 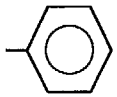 | 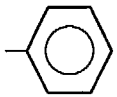 |
| II-9 | 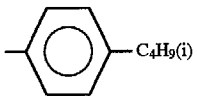  | 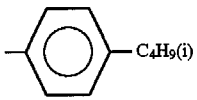  | 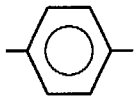 | −H | 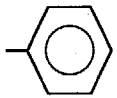 | 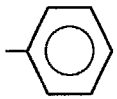 |

-continued
| Compound No. | $Ar^1$ | $Ar^2$ | $Ar^3$ | $R^5$ | $R^6$ | $R^7$ |
|---|---|---|---|---|---|---|
| II-10 | 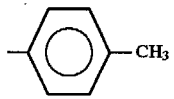 | 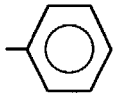 | 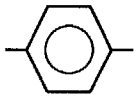 | −H | 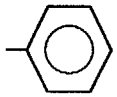 | 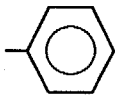 |
| II-11 | 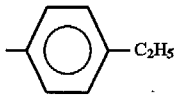 | 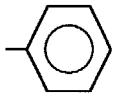 | 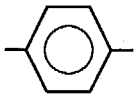 | −H | −H | 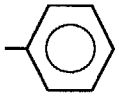 |
| II-12 | 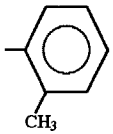 | 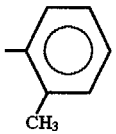 | 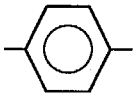 | −H | 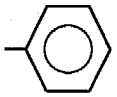 | 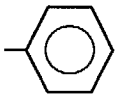 |
| II-13 | 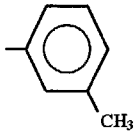 | 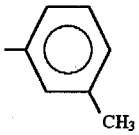 | 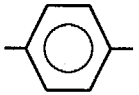 | −H | 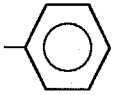 | 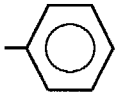 |
| II-14 | 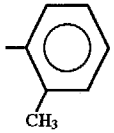 | 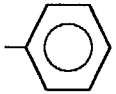 | 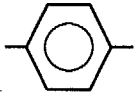 | −H | 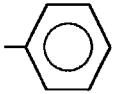 | 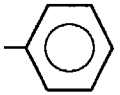 |
| II-15 | 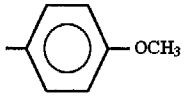 | 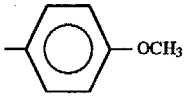 | 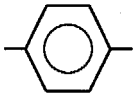 | −H | 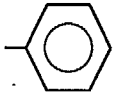 | 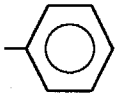 |
| II-16 | 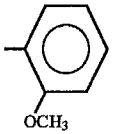 | 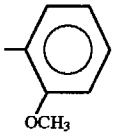 | 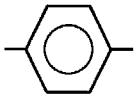 | −H | 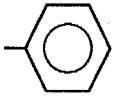 | 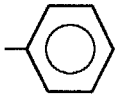 |
| II-17 | 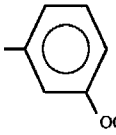 | 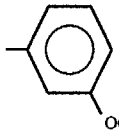 | 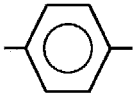 | −H | 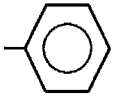 | 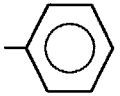 |

-continued
| Compound No. | $Ar^1$ | $Ar^2$ | $Ar^3$ | $R^5$ | $R^6$ | $R^7$ |
|---|---|---|---|---|---|---|
| II-18 | 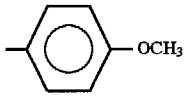 | 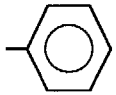 | 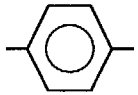 | −H | 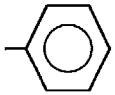 | 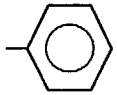 |
| II-19 | 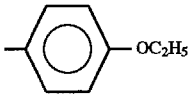 | 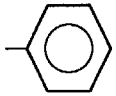 | 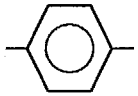 | −H | 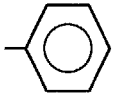 | 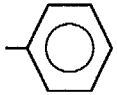 |
| II-20 | 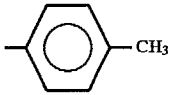 | 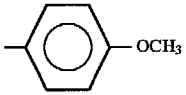 | 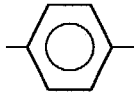 | −H | 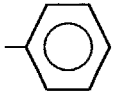 | 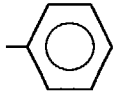 |
| II-21 | 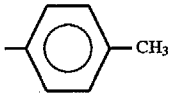 | 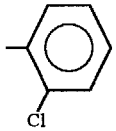 | 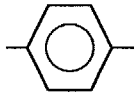 | −H | 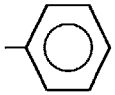 | 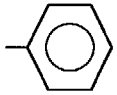 |
| II-22 | 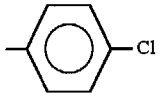 | 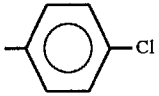 | 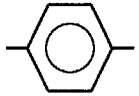 | −H | 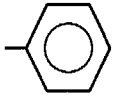 | 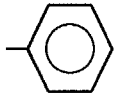 |
| II-23 | 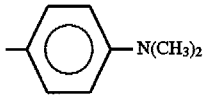 | 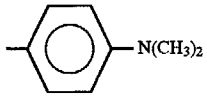 | 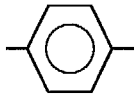 | −H | 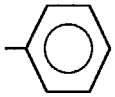 | 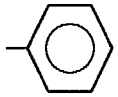 |
| II-24 | 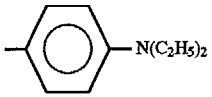 | 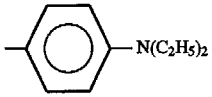 | 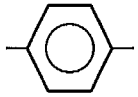 | −H | 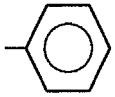 | 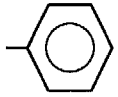 |
| II-25 | 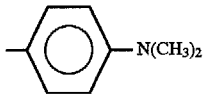 | 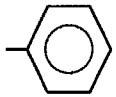 | 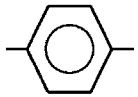 | −H | 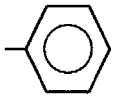 | 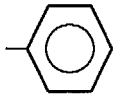 |
| II-26 | 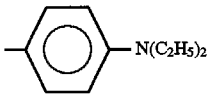 | 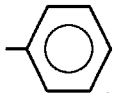 | 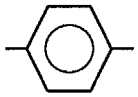 | −H | 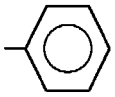 | 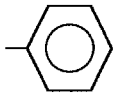 |

-continued
| Compound No. | $Ar^1$ | $Ar^2$ | $Ar^3$ | $R^5$ | $R^6$ | $R^7$ |
|---|---|---|---|---|---|---|
| II-27 | 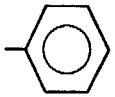 | 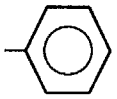 | 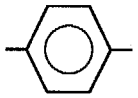 | −H | −H | 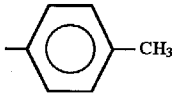 |
| II-28 | 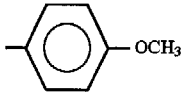 | 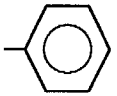 | 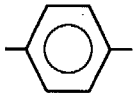 | −H | −H | 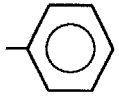 |
| II-29 | 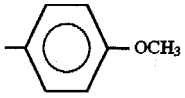 | 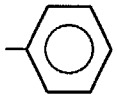 | 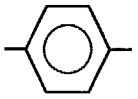 | −H | −H | 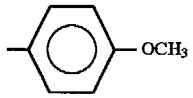 |
| II-30 | 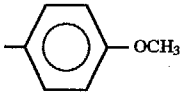 | 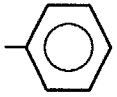 | 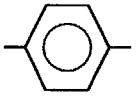 | −H | −H | 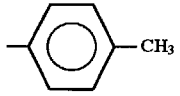 |
| II-31 | 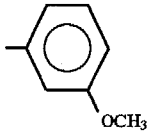 | 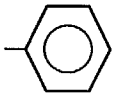 | 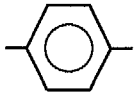 | −H | 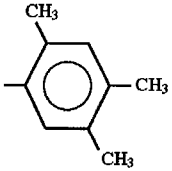 | 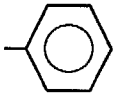 |
| II-32 | 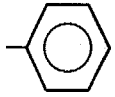 | 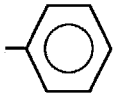 | 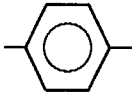 | −H | −H | 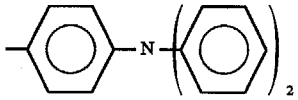 |
| II-33 | 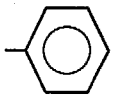 | 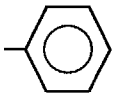 | 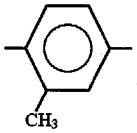 | −H | −H | 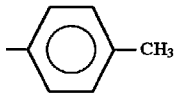 |
| II-34 | 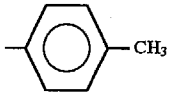 | 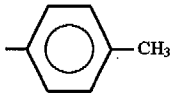 | 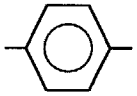 | −H | −H | 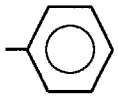 |

-continued
| Compound No. | $Ar^1$ | $Ar^2$ | $Ar^3$ | $R^5$ | $R^6$ | $R^7$ |
|---|---|---|---|---|---|---|
| II-35 | 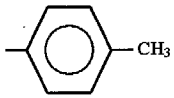 | 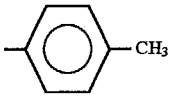 | 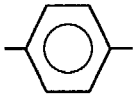 | −H | −H | 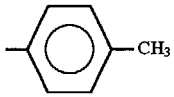 |
| II-36 | 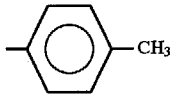 | 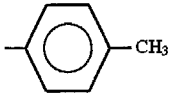 | 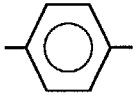 | −H | −H | 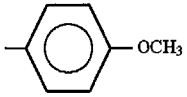 |
| II-37 | 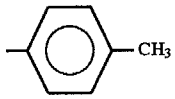 | 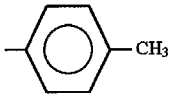 | 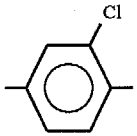 | −H | −H | 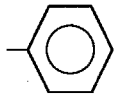 |
| II-38 | 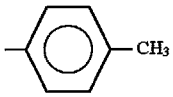 | 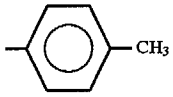 | 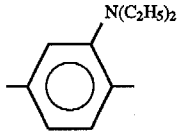 | −H | −H | 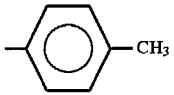 |
| II-39 | 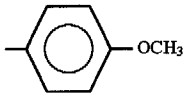 | 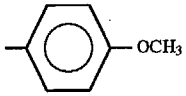 | 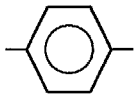 | −H | −H | 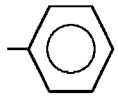 |
| II-40 | 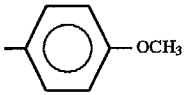 | 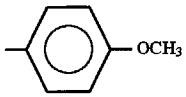 | 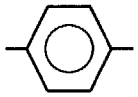 | −H | −H | 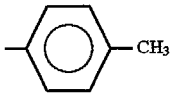 |
| II-41 | 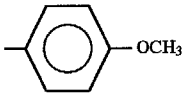 | 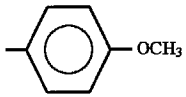 | 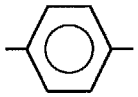 | −H | −H | 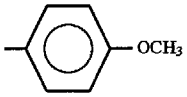 |
| II-42 | 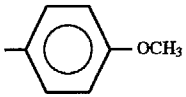 | 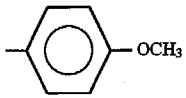 | 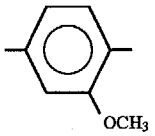 | −H | −H | 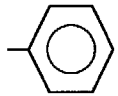 |

-continued
| Compound No. | $Ar^1$ | $Ar^2$ | $Ar^3$ | $R^5$ | $R^6$ | $R^7$ |
|---|---|---|---|---|---|---|
| II-43 | 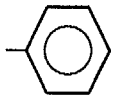 | 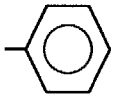 | 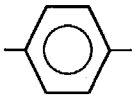 | −H | −H | 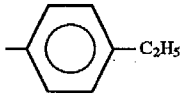 |
| II-44 | 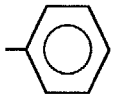 | 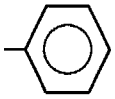 | 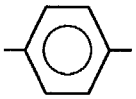 | −H | −H | 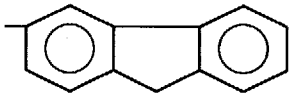 |
| II-45 | 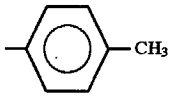 | 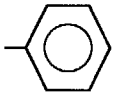 | 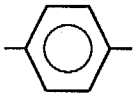 | −H | −H | 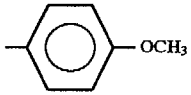 |
| II-46 | 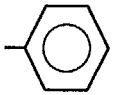 | 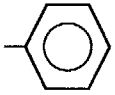 | 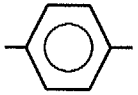 | −H | −H | 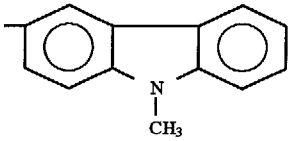 |
| II-47 | 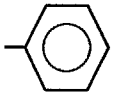 | 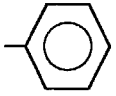 | 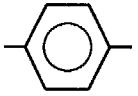 | −H | −H | 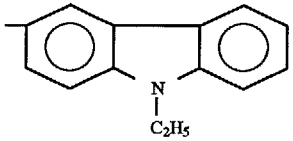 |
| II-48 | 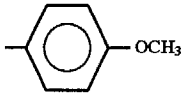 | 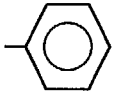 | 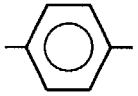 | −H | −H | 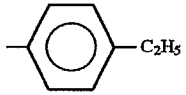 |
| II-49 | 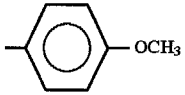 | 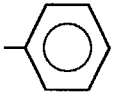 | 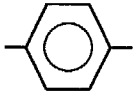 | −H | −H | 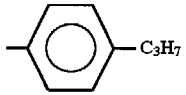 |
| II-50 | 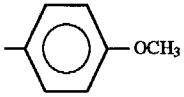 | 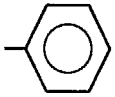 | 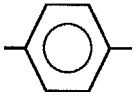 | −H | −H | 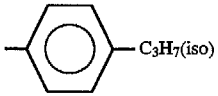 |
| II-51 | 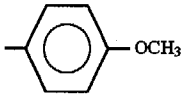 | 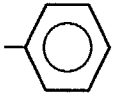 | 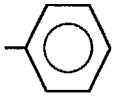 | −H | −H | 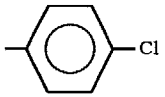 |

-continued
| Compound No. | $Ar^1$ | $Ar^2$ | $Ar^3$ | $R^5$ | $R^6$ | $R^7$ |
|---|---|---|---|---|---|---|
| II-52 | 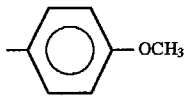 | 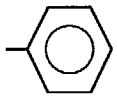 | 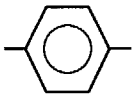 | −H | −H | 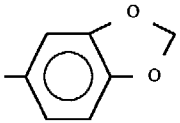 |
| II-53 | 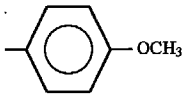 | 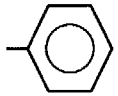 | 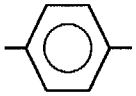 | −H | −H | 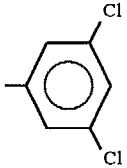 |
| II-54 | 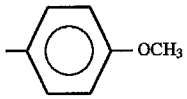 | 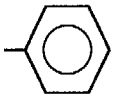 | 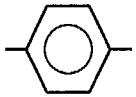 | −H | −H | 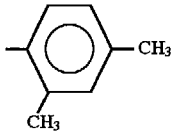 |
| II-55 | 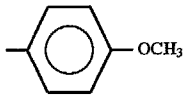 | 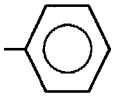 | 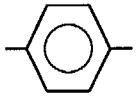 | −H | −H | 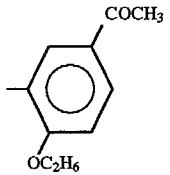 |
| II-56 | 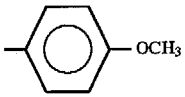 | 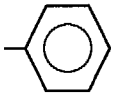 | 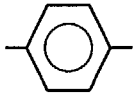 | −H | −H | 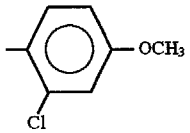 |
| II-57 | 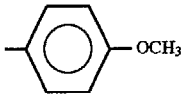 | 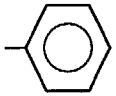 | 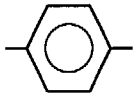 | −H | −H | 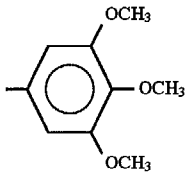 |

-continued
| Compound No. | $Ar^1$ | $Ar^2$ | $Ar^3$ | $R^5$ | $R^6$ | $R^7$ |
|---|---|---|---|---|---|---|
| II-58 | 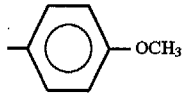 | 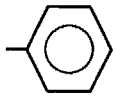 | 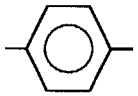 | −H | −H | 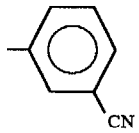 |
| II-59 | 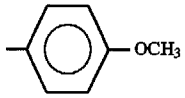 | 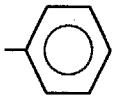 | 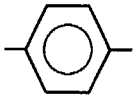 | −H | −H | 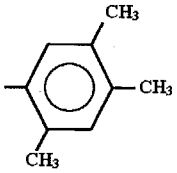 |
| II-60 | 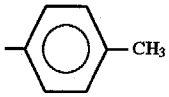 | 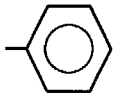 | 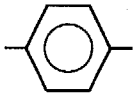 | −H | −H | 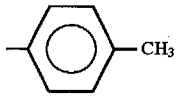 |
| II-61 | 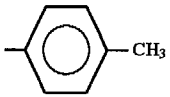 | 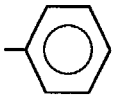 | 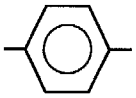 | −H | −H | 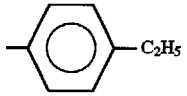 |
| II-62 | 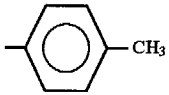 | 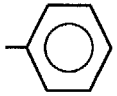 | 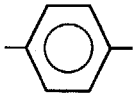 | −H | −H | 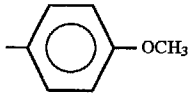 |
| II-63 | 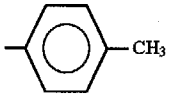 | 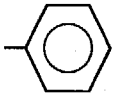 | 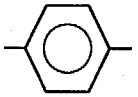 | −H | −H | 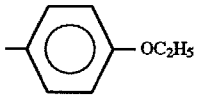 |
| II-64 | 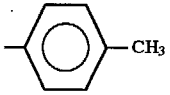 | 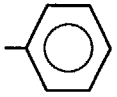 | 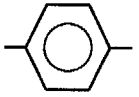 | −H | −H | 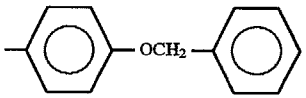 |
| II-65 | 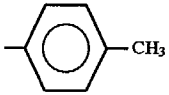 | 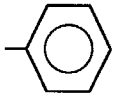 | 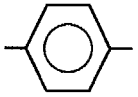 | −H | −H | 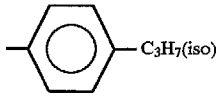 |
| II-66 | 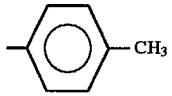 | 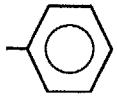 | 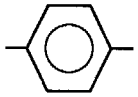 | −H | −H | 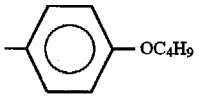 |

-continued
| Compound No. | $Ar^1$ | $Ar^2$ | $Ar^3$ | $R^5$ | $R^6$ | $R^7$ |
|---|---|---|---|---|---|---|
| II-67 | 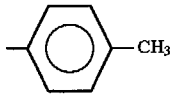 | 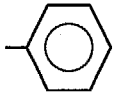 | 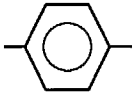 | −H | −H | 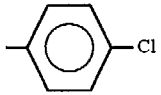 |
| II-68 | 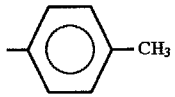 | 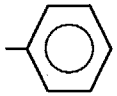 | 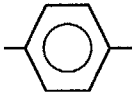 | −H | −H | 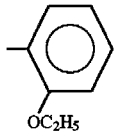 |
| II-69 | 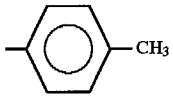 | 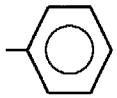 | 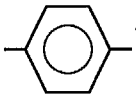 | −H | −H | 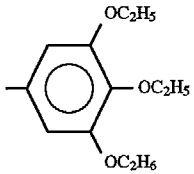 |
| II-70 | 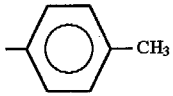 | 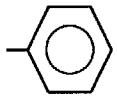 | 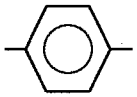 | −H | −H | 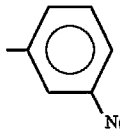 |
| II-71 | 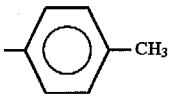 | 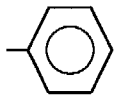 | 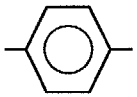 | −H | −H | 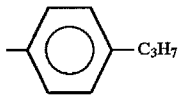 |
| II-72 | 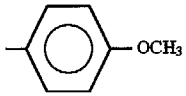 | 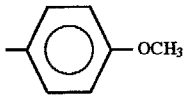 | 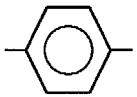 | −H | −H | 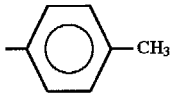 |
| II-73 | 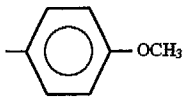 | 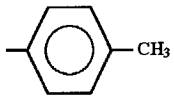 | 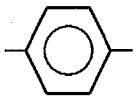 | −H | −H | 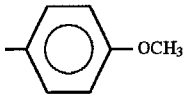 |
| II-74 | 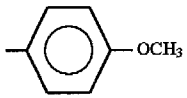 | 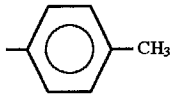 | 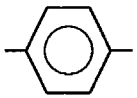 | −H | −H | 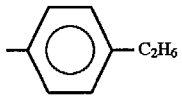 |

-continued
| Compound No. | $Ar^1$ | $Ar^2$ | $Ar^3$ | $R^5$ | $R^6$ | $R^7$ |
|---|---|---|---|---|---|---|
| II-75 | 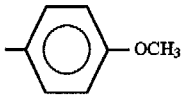 | 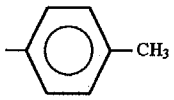 | 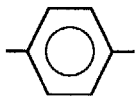 | −H | −H | 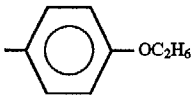 |
| II-76 | 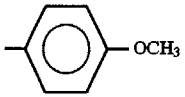 | 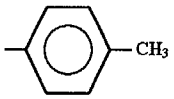 | 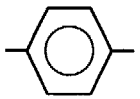 | −H | −H | 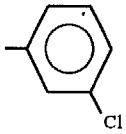 |
| II-77 | 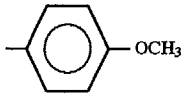 | 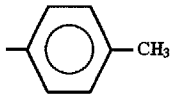 | 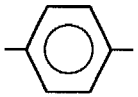 | −H | −H | 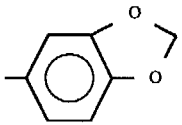 |
| II-78 | 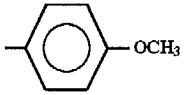 | 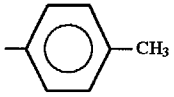 | 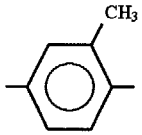 | −H | −H | 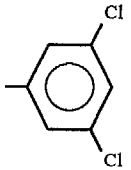 |
| II-79 | 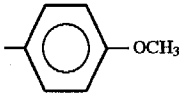 | 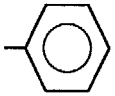 | 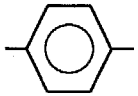 | −H | −H | 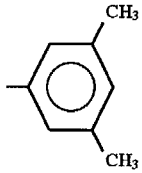 |
| II-80 | 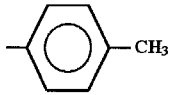 | 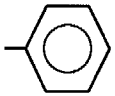 | 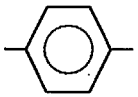 | −H | −H | 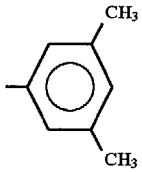 |

-continued
| Compound No. | $Ar^1$ | $Ar^2$ | $Ar^3$ | $R^5$ | $R^6$ | $R^7$ |
|---|---|---|---|---|---|---|
| II-81 | 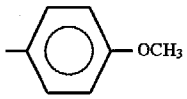 | 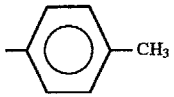 | 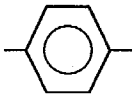 | −H | −H | 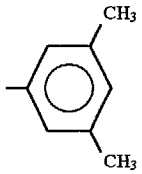 |
| II-82 | 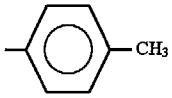 | 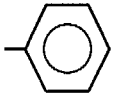 | 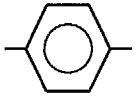 | −H | −H | 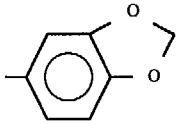 |
| II-83 | 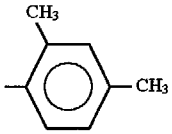 | 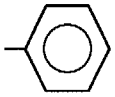 | 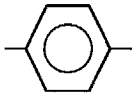 | $-CH_3$ | −H | 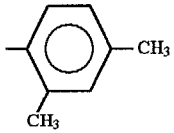 |
| II-84 | 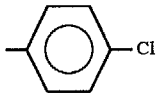 | 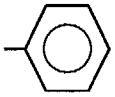 | 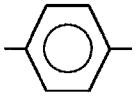 | $-CH_3$ | −H | 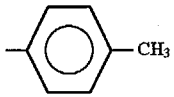 |
| II-85 | 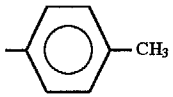 | 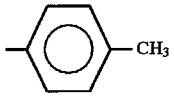 | 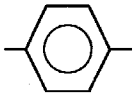 | −H | $-CH_3$ | 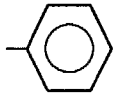 |
| II-86 | 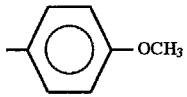 | 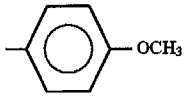 | 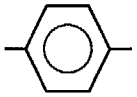 | −H | $-CH_3$ | 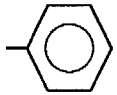 |
| II-87 | 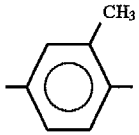 | 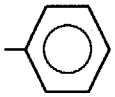 | 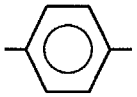 | −H | 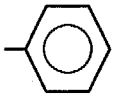 | 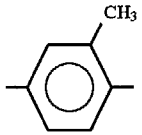 |
| II-88 | 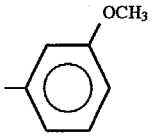 | 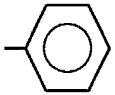 | 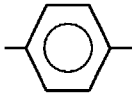 | −H | 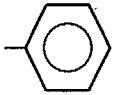 | 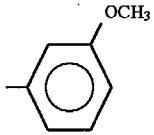 |

-continued
| Compound No. | $Ar^1$ | $Ar^2$ | $Ar^3$ | $R^5$ | $R^6$ | $R^7$ |
|---|---|---|---|---|---|---|
| II-89 | 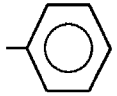 | 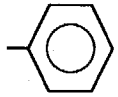 | 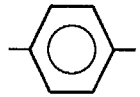 | −H | 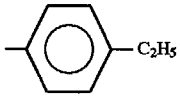 | 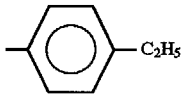 |
| II-90 | 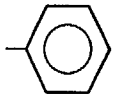 | 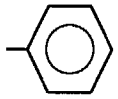 | 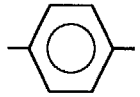 | −H | −H | 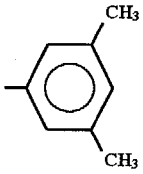 |
| II-91 | 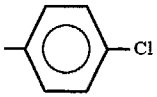 | 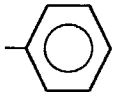 | 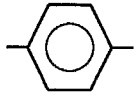 | −H | −H | 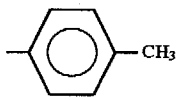 |
| II-92 | 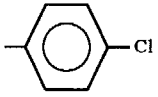 | 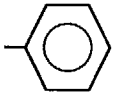 | 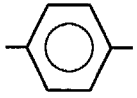 | −H | 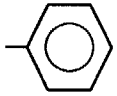 | 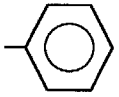 |
| II-93 | 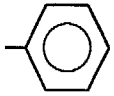 | 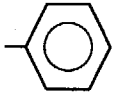 | 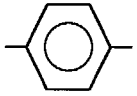 | −H | 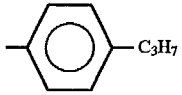 | 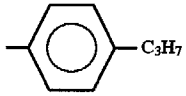 |
| II-94 | 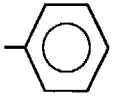 | 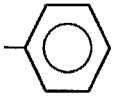 | 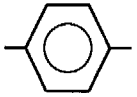 | −H | −H | 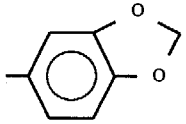 |
| II-95 | 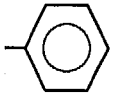 | 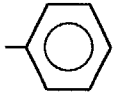 | 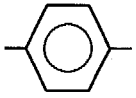 | −H | 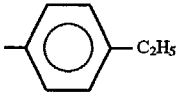 | 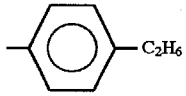 |
| II-96 | 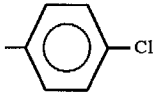 | 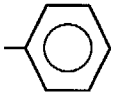 | 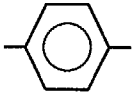 | −H | −H | 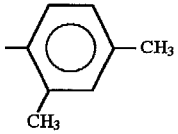 |

-continued
| Compound No. | $Ar^1$ | $Ar^2$ | $Ar^3$ | $R^5$ | $R^6$ | $R^7$ |
|---|---|---|---|---|---|---|
| II-97 | 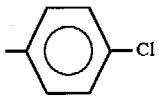 | 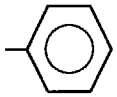 | 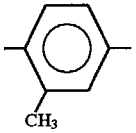 | −H | 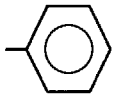 | 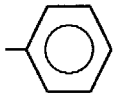 |
| II-98 | 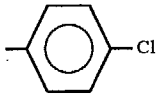 | 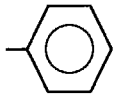 | 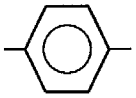 | −H | −H | 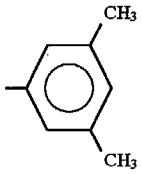 |
| II-99 | 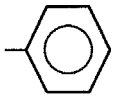 | 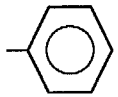 | 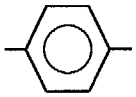 | −H | −H | 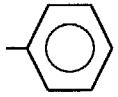 |
| II-100 | 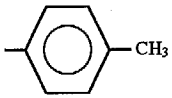 | 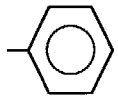 | 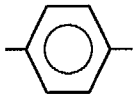 | −H | −H | 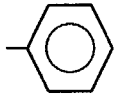 |
| II-101 | 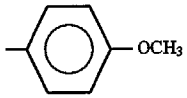 | 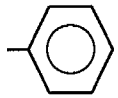 | 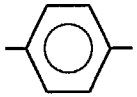 | −H | 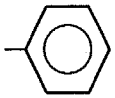 | 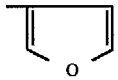 |
| II-102 | 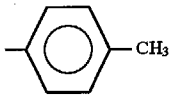 | 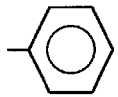 | 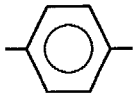 | −H | −H | 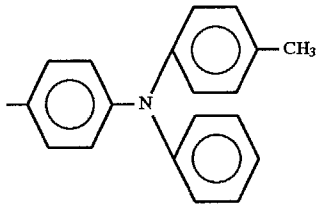 |
| II-103 | 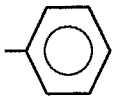 | 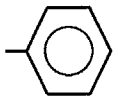 | 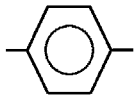 | −H | 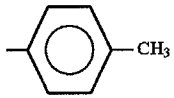 | 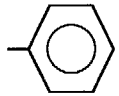 |
| II-104 | 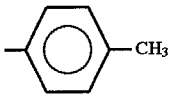 | 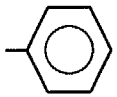 | 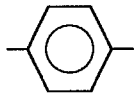 | −H | 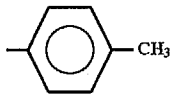 | 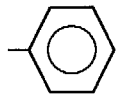 |

-continued
| Compound No. | $Ar^1$ | $Ar^2$ | $Ar^3$ | $R^5$ | $R^6$ | $R^7$ |
|---|---|---|---|---|---|---|
| II-105 | 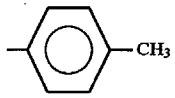 | 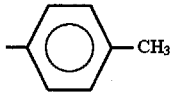 | 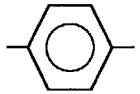 | −H | 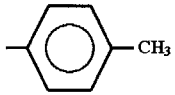 | 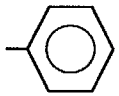 |
| II-106 | 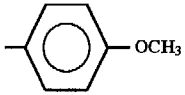 | 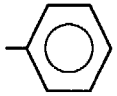 | 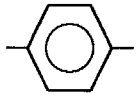 | −H | 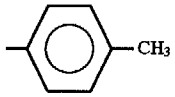 | 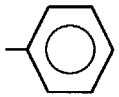 |
| II-107 | 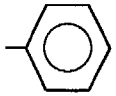 | 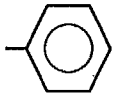 | 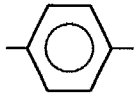 | −H | 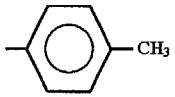 | 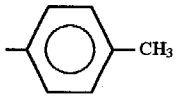 |
| II-108 | 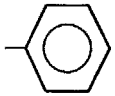 | 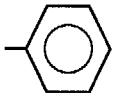 | 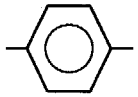 | −H | | 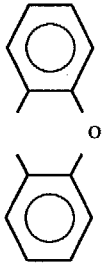 |
| II-109 | 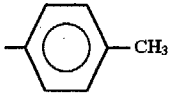 | 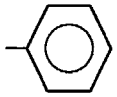 | 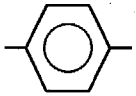 | −H | | 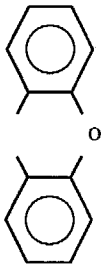 |

-continued
| Compound No. | $Ar^1$ | $Ar^2$ | $Ar^3$ | $R^5$ | $R^6$ | $R^7$ |
|---|---|---|---|---|---|---|
| II-110 | 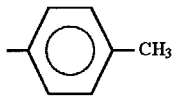 | 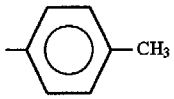 | 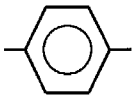 | −H | | 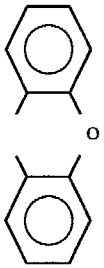 |
| II-111 | 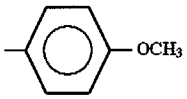 | 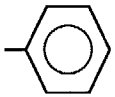 | 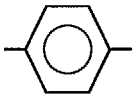 | −H | | 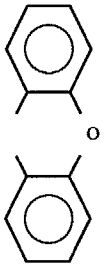 |
| II-112 | 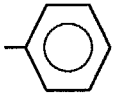 | 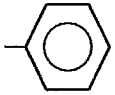 | 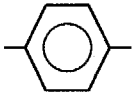 | −H | | 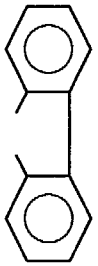 |

-continued
| Compound No. | $Ar^1$ | $Ar^2$ | $Ar^3$ | $R^5$ | $R^6$ | $R^7$ |
|---|---|---|---|---|---|---|
| II-113 | 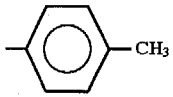 | 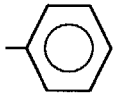 | 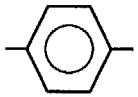 | −H | | 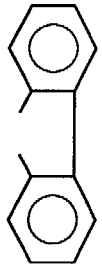 |
| II-114 | 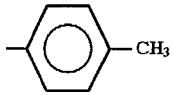 | 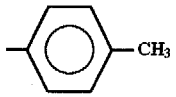 | 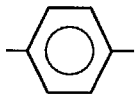 | −H | | 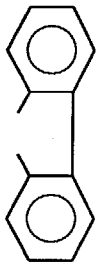 |
| II-115 | 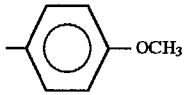 | 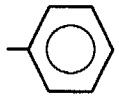 | 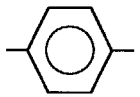 | −H | | 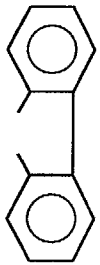 |

-continued
| Compound No. | $Ar^1$ | $Ar^2$ | $Ar^3$ | $R^5$ | $R^6$ | $R^7$ |
|---|---|---|---|---|---|---|
| II-116 | 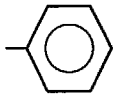 | 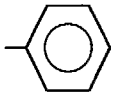 | 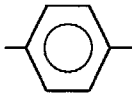 | −H | | 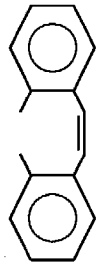 |
| II-117 | 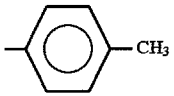 | 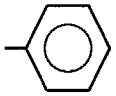 | 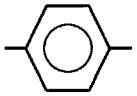 | −H | | 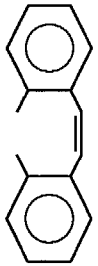 |
| II-118 | 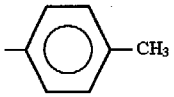 | 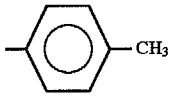 | 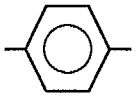 | −H | | 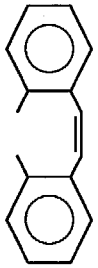 |

-continued
| Compound No. | $Ar^1$ | $Ar^2$ | $Ar^3$ | $R^5$ | $R^6$ | $R^7$ |
|---|---|---|---|---|---|---|
| II-119 | 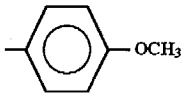 | 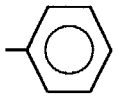 | 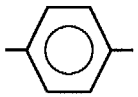 | −H | | 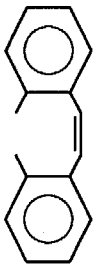 |

(b) Specific examples for p=1.

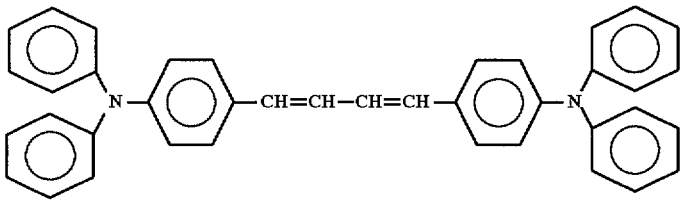

II-120

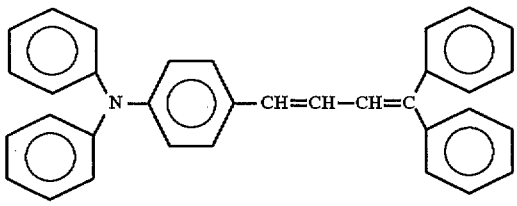

II-121

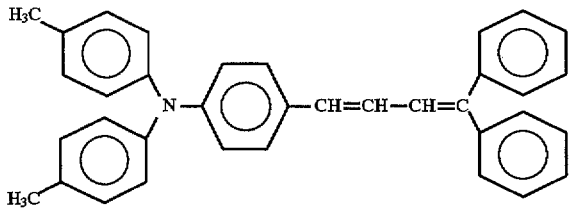

II-122

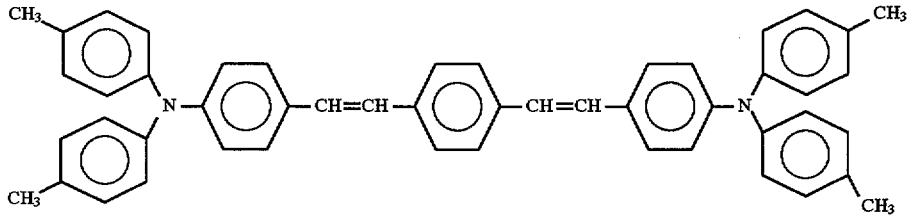

II-123

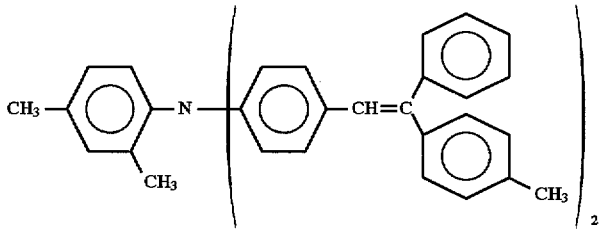

II-124

The reasons why these compounds are preferably employed in the present invention is not entirely clear. However, it is considered to be related to excellent conformity of the electrostatic and adhesion properties to those of the titanyl phthalocyanine pigments of the present invention. In addition, high carrier mobility in these compounds may further facilitate to synergistically enhance the intrinsic characteristics of the titanyl phthalocyanine pigments.

Suitable examples of binder resins useful in the charge transport layer include thermoplastic resins and thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenolic resin and alkyd resin.

The amount of the binder resin is preferably from 20 to 300 parts by weight and more preferably from 40 to 100 parts by weight, to 100 parts by weight of the charge transport material. The thickness of the charge transport layer is preferably from 5 to 50 microns.

Examples of suitable solvent for the preparation of the charge transport layer include chloroform, tetrahydrofuran, dioxane, toluene, monochlorobenzene, dichloroethane, dichloromethane, cylohexanone, methyl ethyl ketone and acetone.

As aforementioned, plasticizers, leveling agents and/or antioxidants may further be included in the charge transport layer.

Any plasticizer conventionally used for resins such as dibutylphthalate and dioctylphthalate can be employed in the present invention and the amount of the plasticizer is preferably from less than or equal to 30 parts by weight to 100 parts by weight of the binder resin.

Silicone oils such as dimethyl silicone oil and methylphenyl silicone oil, and polymers and oligomers having a perfluoroalkyl group on a side chain thereof can be used as the leveling agents in the charge transport layer. The amount of the leveling agent is preferably less than or equal to 1 part by weight to 100 parts by weight of the binder resin.

As the antioxidants in the charge transport layer, any of conventionally used antioxidants such as hindered phenol compounds, sulfur compounds, phosphor compounds, or hindered amine compounds can be employed. The amount of the antioxidants is preferably less than or equal to 5 parts by weight to 100 parts by weight of the binder resin.

As shown in FIGS. 1 and 2, the intermediate layer 13 can be provided between the conductive supporting substrate 11 and the charge generation layer. The intermediate layer comprises titanium dioxide having a purity of 99.2% by weight, and melamine resin, as aforementioned.

As the binder resin for the intermediate layer 13, melamine resin is preferably employed. Since the charge generation layer 15 and the charge transport layer 17 are generally coated with solvent on the intermediate layer, it is preferable for the intermediate layer to be rendered more insoluble to conventional organic solvents. Also, thermosetting resins can additionally be included in the intermediate layer to improve the hardening property. Examples of such thermosetting resin include resins, which are hardened in a three dimensional network structure, such as isocyanate resin, alkyl resin, acrylic resin, and epoxy resin.

The amount of the melamine resin in the intermediate layer is preferably 20% or more by weight based on the total amount of resin therein. For an amount of less than 20% of the melamine resin, the above-mentioned effects, such as dispersion of the titanium dioxide, and degree of thermosetting, are reduced.

The intermediate layer 13 of the present invention can be provided by using suitable solvents, and also by a method of dispersing and coating, similar to those used for the charge generation layer and the charge transport layer.

The intermediate layer may further comprise an organometallic compound such as a silane coupling agent, titanium coupling agent, chromium coupling agent, titanyl chelate compound, zirconium chelate compound, and/or titanyl alkoxide compound.

The intermediate layer may preferably have a thickness of from 1 to 10 microns.

The protective layer 21 is provided to protect the surface of, and improve the durability of, the photoconductor of the present invention.

Examples of a resin for use in the protective layer include acrylonitrile-butadiene-styrene(ABS)resin, copolymer of olefin and vinyl monomer, chlorinated polyether, acrylic resin, phenol resin, polyacetal, polyamide, polyamideimide, polyacrylate, polyallyl sulfone, polybutylene, polybutylene terephthalate, polycarbonate, polyether sulfone, polyethylene, polyethylene terephthalate, polyimide, acrylic resin, polymethylpentene, polypropylene, polyphenyleneoxide, polysulfone, polystyrene, acrylonitrile-styrene(AB)resin, butadiene-styrene copolymer, polyurethane, polyvinyl chloride, polyvinylidene chloride, and epoxy resin.

In order to improve the wear resistance, the protective layer may further comprise a fluorine-containing resin such as polytetrafluoroethylene, and a silicone resin. In such a case, an inorganic material such as titanium dioxide, tin oxide or potassium titanate may be dispersed in the above-mentioned fluorine containing resin or silicone resin.

The protective layer is formed by a conventional coating method. The thickness of the protective layer is preferably from 0.1 to 10 microns in the present invention. Furthermore, a vacuum deposited film of conventional amorphous carbon or amorphous carbon silicide may also be employed as the protective layer of the present invention.

In the present invention, an additional intermediate layer (not shown in the Figs.) may be provided between the charge transport layer 17 and the protective layer 21.

The additional intermediate layer comprises a binder resin as the main component such as polyamide, alcohol-soluble nylon resin, water-soluble vinyl butyral resin, polyvinyl butyral, or polyvinyl alcohol.

The additional intermediate layer can-be formed by the conventional coating method. The thickness of the additional intermediate layer is preferably from 0.05 to 2 microns.

Having generally described this invention, a further understanding can be obtained by reference to certain specific examples which are provided herein for purposes of illustration only and are not intended to be limiting. In the description in the following examples, numerals are parts by weight unless otherwise indicated.

EXAMPLES

A variety of electrophotographic photoconductor were fabricated according to the present invention which follow.

Titanyl phthalocyanine pigments for use in the present invention were prepared as follows.

A mixture of 52.5 g of 0.41 mole phthalodinitrile and 300 ml of 1-chloronaphthalene was stirred and added with 19.0 g of 0.10 mole of titanium tetrachloride by dropping under a nitrogen atmosphere. The temperature of the solution was then gradually raised to 200° C. and a reaction was carried out in the solution for 5 hours at the temperature of from 190° to 210° C. Following the reaction, the solution was gradually cooled down to 130° C., filtered, washed to obtain blue 1-chloronaphthalene crystals, washed for several times with methanol and then with water of 80° C., and dried to obtain 42.2 g of crude titanyl phthalocyanine pigment with a yield of 73.3% by weight. A portion of the crude titanyl phthalocyanine of 6 g was added into 100 g of 96% sulfuric acid at from 3° to 5° C., stirred to dissolve, and filtered. The thus obtained solution was added by dropping with stirring into 3.5 liter of ice water and crystals were separated by filtering and rinsed up to the point where the rinsed water exhibited neutrality and a wet cake of titanyl phthalocyanine was obtained.

Figure 3:
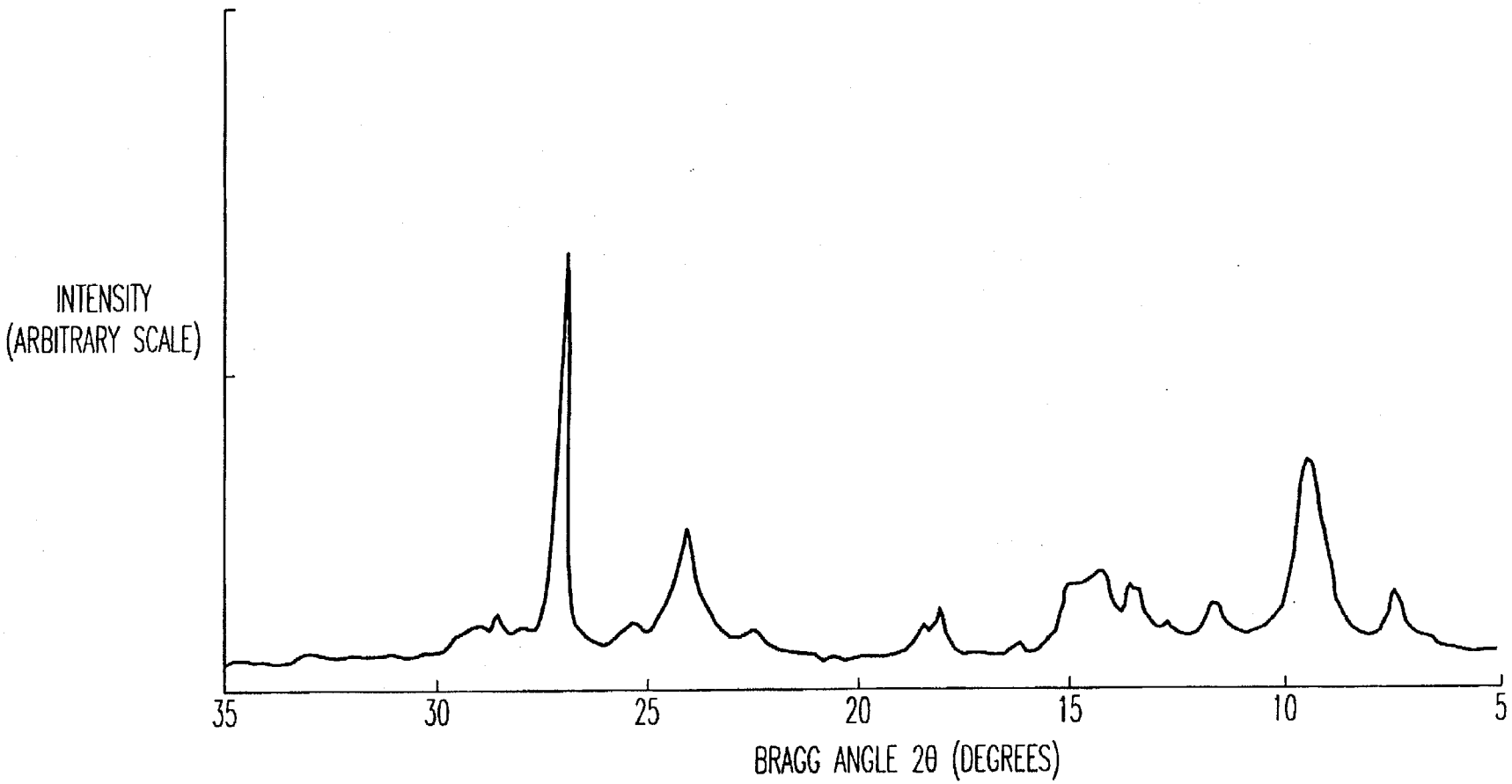
FIG. 3 is an x-ray diffraction pattern of a titanyl phthalocyanine pigment of the present invention.

Subsequently, by adding 100 g of 1,2-dichloroethane into the wet cake, stirring for 2 hours at room temperature, adding 300 ml of methanol, filtering, washing with methanol, and then drying, 4.9 g of titanyl phthalocyanine pigments of the present invention were obtained. X-ray diffraction pattern of the presently obtained titanyl phthalocyanine pigments exhibits main peaks at Bragg angles 2θ of 9.5° and 27.2° as shown in FIG. 3. The x-ray diffraction pattern was recorded under the conditions:

x-ray tube with Cu anode,
voltage applied 40 kV,
filament current 20 mA,
scanning speed 1°/min,
range of scanning 3°~35°, and
time constant 2 sec.

Example 1

An electrophotographic photoconductor of the present invention was fabricated in accordance with steps and apparatus which follow.

Formation of Intermediate Layer

A mixture of the following components was prepared by dispersing for 72 hours in a ball mill to obtain a coating composition for an intermediate layer.

| | |
|---|---|
| $TiO_2$ (99.7% purity, CR-EL sold by Ishihara Sangyou Co) | 75 |
| Alkyd resin (50% solid, Bekkolite M 6401-50-S by Dai Nippon Ink and Chemicals Co) | 15 |
| Melamine resin (60% solid, Super Beckamin L-121-60 by Dai Nippon Ink and Chemicals Co) | 10 |
| Methyl ethyl ketone | 100 |

The coating composition was coated on a plate of aluminum (A1080 sold by Sumitomo Light Metal Co) of 0.2 mm thick, and dried for 20 min at 130° C. temperature to obtain an intermediate layer of a thickness of about 3 microns.

Formation of Charge Generation Layer

A mixture of the following components was dispersed in a sand mill for 2 hours with glass beads of 1 mm diameter

| | |
|---|---|
| Titanyl phthalocyanine pigments prepared as above-mentioned: | 2 |
| Butyral resin (37 mole % of hydroxy group) | 2 |
| Cyclohexanone | 100 |

The thus prepared liquid was diluted with 100 parts of methyl ethyl ketone to obtain a charge generation layer coating composition.

The coating composition prepared as above was coated on the previously prepared intermediate layer and then dried at 80° C. for 10 minutes to form a charge generation layer with a thickness of about 0.2 micron.

Formation of Charge Transport Layer

A coating composition for a charge transport layer was prepared by dissolving the following components in 100 parts of dichloromethane.

Charge transporting material of the formula (III):

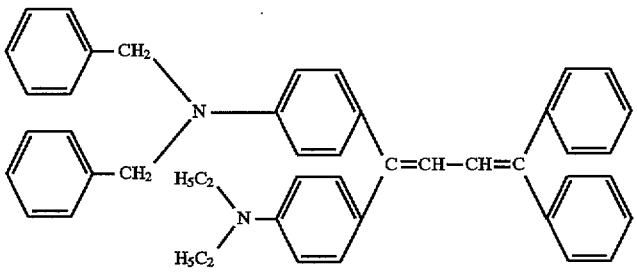

(III)

| | |
|---|---|
| Polycarbonate (Yupiron Z-300 by Mitsubishi Gas Chemical Co) | 7 |
| Silicone oil (Kf-50 sold by Sin-Etsu Chemical Co) | 10 |
| | 0.002 |

This solution was coated onto the charge generation layer prepared as above, and then dried at 130° C. temperature for 15 min to form a charge transport layer of a thickness of about 20 microns.

The above-noted charge generation layer, along with the charge transport layer and the intermediate layer, constituted an electrophotographic photoconductor of Example 1 in the present invention.

Example 2

An electrophotographic photoconductor was fabricated in a similar manner to Example 1, with the exception that titanium dioxide particles (JA-1 sold by Teikoku Chemical Co) were used after repeatedly rinsed with hot water to obtain particles with a purity of 99.2% by weight.

Example 3

An electrophotographic photoconductor was fabricated in a similar manner to Example 1, with the exception that aminobiphenyl compound No. (I)-35 was used in place of the charge transport material in Example 1.

Example 4

An electrophotographic photoconductor was fabricated in a similar manner to Example 1, with the exception that aminobiphenyl compound No. (I)-55 was used in place of the charge transport material in Example 1.

Example 5

An electrophotographic photoconductor was fabricated in a similar manner to Example 2, with the exception that aminobiphenyl compound No. (I)-35 was used in place of the charge transport material in Example 2.

Example 6

An electrophotographic photoconductor was fabricated in a similar manner to Example 2, with the exception that aminobiphenyl compound No. (I)-106 was used in place of the charge transport material in Example 2.

Example 7

An electrophotographic photoconductor was fabricated in a similar manner to Example 3, with the exception that titanium dioxide particles of 99.9% purity by weight (TP-2 sold by Fuji Titan Co) were used.

Example 8

An electrophotographic photoconductor was fabricated in a similar manner to Example 3, with the exception that titanium dioxide particles of 99.6% purity by weight (TM-1 sold by Fuji Titan Co) were used.

Example 9

An electrophotographic photoconductor was fabricated in a similar manner to Example 3, with the exception that butyral resin having 43 mole % of hydroxy group was used in the charge generation layer.

Example 10

An electrophotographic photoconductor was fabricated in a similar manner to Example 4, with the exception that butyral resin having 43 mole % of hydroxy group was used in the charge generation layer.

Example 11

An electrophotographic photoconductor was fabricated in a similar manner to Example 3, with the exception that butyral resin having 33 mole % of hydroxy group was used in the charge generation layer.

Example 12

An electrophotographic photoconductor was fabricated in a similar manner to Example 4, with the exception that butyral resin having 33 mole % of hydroxy group was used in the charge generation layer.

Comparative Example 1
Trisazo pigment

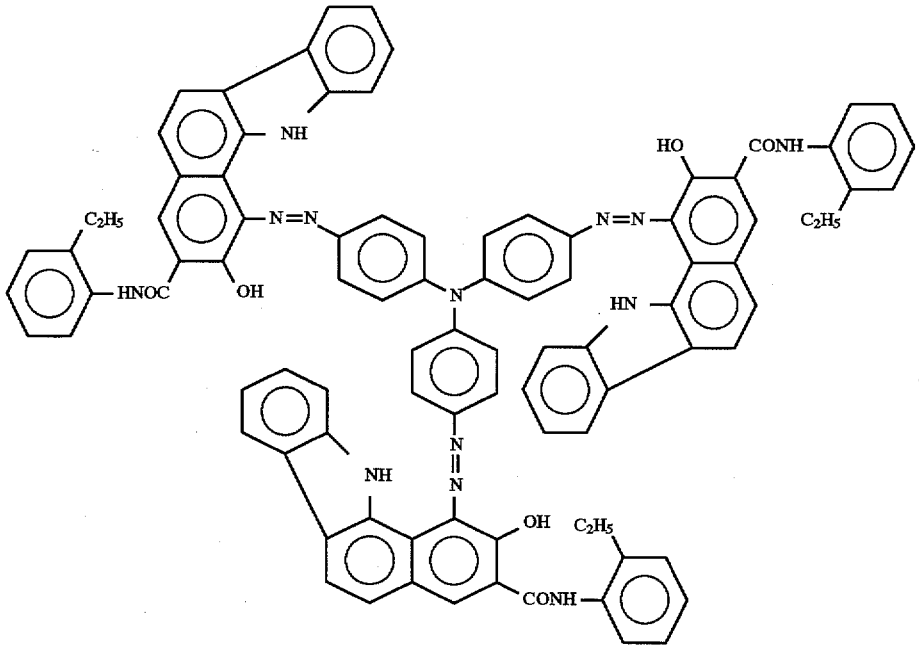

Examples 13 through 22

A variety of electrophotographic photoconductor were fabricated in a similar manner to Example 1, with the exception that each of the purity of titanium dioxide particles in the intermediate layer, the amount of hydroxy group in butyral resin in the charge generation layer, and charge transport material was selected as shown in Table 1.

TABLE I

| Example No. | $TiO_2$, Purity(weight %) | Butyral resin, Hydroxy group (mole %) | Charge transport material |
|---|---|---|---|
| Ex. 13 | 99.7 | 33 | II-6 |
| Ex. 14 | 99.7 | 33 | II-104 |
| Ex. 15 | 99.7 | 37 | II-6 |
| Ex. 16 | 99.7 | 37 | II-104 |
| Ex. 17 | 99.9 | 37 | II-6 |
| Ex. 18 | 99.6 | 37 | II-6 |
| Ex. 19 | 99.2 | 37 | II-6 |
| Ex. 20 | 99.2 | 37 | II-28 |
| Ex. 21 | 99.7 | 43 | II-6 |
| Ex. 22 | 99.7 | 43 | II-104 |

Comparative Examples 1 through 3

Electrophotographic photoconductors were fabricated in a similar manner to Example 1, with the exception that each of the following pigments was used as a charge generation material in place of the titanyl phthalocyanine pigment in Example 1.

Comparative Example 2 x-type of metal-free phthalocyanine pigment (Fastgenblue 8120B by Dai Nippon Ink and Chemicals Co)

Comparative Example 3

τ-type of metal-free phthalocyanine pigment (Liophoton TPH-278 by Toyo Ink Co)

Comparative Examples 4 through 6

Electrophotographic photoconductor fabrication was carried out in a similar manner to Example 3, with the exception that each of the pigments used in each of the above Comparative Examples 1 through 3 was used as a charge generation material in place of the titanyl phthalocyanine pigment.

Comparative Examples 7 through 9

Electrophotographic photoconductor fabrication was carried out in a similar manner to Example 15, with the exception that each of the pigments used in each of the above Comparative Examples 1 through 3 was used as a charge generation material in place of the titanyl phthalocyanine pigment.

Comparative Examples 10 through 27

A variety of electrophotographic photoconductor were fabricated in a similar manner to Example 1, with the exception that each of the purity of titanium dioxide particles in the intermediate layer, binder resin in the intermediate layer, the amount of hydroxy group in butyral resin in the charge generation layer, binder resin in the charge generation layer, and charge transport material was selected as shown in Table 2.

In these Comparative Examples, (1) the binder resin was added in an amount of 13.5 parts by weight to 75 parts by weight of titanium oxide, (2) the amounts of alkyd and melamine were selected as the same as Example 1, (3) as organic solvent for polyamide resin, methanol was used in place of methyl ethyl ketone.

The amount of binder resin added into the charge generation layer was 1 part by weight to 1 part by weight of phthalocyanine pigment.

TABLE 2

| | Intermediate Layer | | Charge Generation Layer | | |
|---|---|---|---|---|---|
| | $TiO_2$ | | | | |
| Comparative Example | purity (wt %) | Binder resin | Binder resin | Hydroxy value (mole %) | Charge trans material |
| Comp.Ex.10 | 99.7 | polyamide | butyral | 37 | I-35 |
| Comp.Ex.11 | 99.7 | phenol | " | 37 | I-35 |
| Comp.Ex.12 | 99.7 | epoxy | " | 37 | I-35 |
| Comp.Ex.13 | 98.0 | alkyd/melamine | " | 37 | I-35 |
| Comp.Ex.14 | 97.0 | " | " | 37 | I-35 |
| Comp.Ex.15 | 99.7 | " | silicone | 0 | I-35 |
| Comp.Ex.16 | 99.7 | " | butyral | 30 | I-35 |
| Comp.Ex.17 | 99.7 | " | " | 25 | I-35 |
| Comp.Ex.18 | 99.7 | " | polyester | 0 | I-35 |
| Comp.Ex.19 | 99.7 | polyamide | butyral | 37 | II-6 |
| Comp.Ex.20 | 99.7 | phenol | " | 37 | II-6 |
| Comp.Ex.21 | 99.7 | epoxy | " | 37 | II-6 |
| Comp.Ex.22 | 98.0 | alkyd/melamine | " | 37 | II-6 |
| Comp.Ex.23 | 97.0 | " | " | 37 | II-6 |
| Comp.Ex.24 | 99.7 | " | silcone | 0 | II-6 |
| Comp.Ex.25 | 99.7 | " | butyral | 30 | II-6 |
| Comp.Ex.26 | 99.7 | " | " | 25 | II-6 |
| Comp.Ex.27 | 99.7 | " | polyester | 0 | II-6 |

Polyamide: Amiran CM-8000 (Toray Co)
Phenol resin: Plyophen J-325 (Dai Nippon Ink and Chemicals Co)
Epoxy resin: U-33 (Amicon Japan Co)
Silicoene resin: KR5240 (Shin-Etsu Chemical Co)
Polyester: Vylon (Toyobo Co)

The electrophotographic photoconductor fabricated in the Examples and Comparative Examples were subsequently subjected to electrostatic evaluation tests, which were carried out in the dynamic mode at 25° C. temperature and 50% relative humidity with an electrostatic tester EPA-8100 from Kawaguchi Electric Co. In the tests, the photoconductors were negatively charged by corona charging at −5.2 kV for 5 sec and a surface potential after 2 sec was measured to obtain V2 (−V). Subsequently, when the surface potential of the photoconductor was decreased to −800 V, the photoconductor was exposed to light filtered to have a wavelength of 780 nm with an intensity of 0.56 μW/cm$^2$. Measurements were then carried out for both of (1) E1/5 (μJ/cm$^2$), the quantity of light required to decrease the surface potential to −160 V, i.e. one fifth of the initial value −800 V, and (2) V30(−V), the surface potential after 30 sec of light exposure.

In addition, the photoconductors were also subjected to fatigue tests. In these tests, corona charging at −5 kV and exposure to 45 lux light from a tungsten lamp of 2856 deg K color temperature were repeatedly carried out in the dynamic mode for 60 min for the photoconductor, surface potential measurements similar to those above-mentioned were then performed for the photoconductor.

The results of the evaluation tests are shown in Table 3.

TABLE 3

| | At the initial stage | | | After fatigued | | |
|---|---|---|---|---|---|---|
| | V2(-V) | E1/5 | V30(-V) | V2(-V) | E1/5 | V30(-V) |
| Ex. 1 | 770 | 0.30 | 13 | 730 | 0.31 | 17 |
| Ex. 2 | 765 | 0.30 | 15 | 725 | 0.31 | 19 |
| Ex. 3 | 795 | 0.24 | 10 | 750 | 0.24 | 10 |
| Ex. 4 | 800 | 0.25 | 11 | 755 | 0.25 | 11 |
| Ex. 5 | 790 | 0.26 | 15 | 745 | 0.26 | 16 |
| Ex. 6 | 790 | 0.26 | 16 | 745 | 0.26 | 15 |
| Ex. 7 | 805 | 0.25 | 12 | 760 | 0.25 | 13 |
| Ex. 8 | 800 | 0.25 | 12 | 755 | 0.25 | 12 |
| Ex. 9 | 805 | 0.25 | 12 | 765 | 0.25 | 11 |
| Ex.10 | 805 | 0.26 | 13 | 765 | 0.26 | 12 |
| Ex.11 | 795 | 0.23 | 9 | 750 | 0.23 | 9 |
| Ex.12 | 800 | 0.24 | 10 | 755 | 0.24 | 10 |
| Ex.13 | 795 | 0.23 | 10 | 750 | 0.23 | 10 |
| Ex.14 | 800 | 0.24 | 11 | 755 | 0.24 | 11 |
| Ex.15 | 795 | 0.24 | 10 | 750 | 0.24 | 10 |
| Ex.16 | 800 | 0.25 | 12 | 755 | 0.25 | 11 |
| Ex.17 | 805 | 0.25 | 12 | 760 | 0.25 | 12 |
| Ex.18 | 800 | 0.25 | 12 | 755 | 0.25 | 11 |
| Ex.19 | 785 | 0.26 | 15 | 740 | 0.26 | 15 |
| Ex.20 | 790 | 0.26 | 16 | 740 | 0.26 | 17 |
| Ex.21 | 800 | 0.25 | 12 | 760 | 0.25 | 12 |
| Ex.22 | 805 | 0.26 | 13 | 765 | 0.26 | 12 |
| Comp.Ex. 1 | 760 | 1.02 | 10 | 500 | 0.96 | 15 |
| Comp.Ex. 2 | 785 | 1.15 | 6 | 550 | 1.08 | 102 |
| Comp.Ex. 3 | 720 | 1.10 | 15 | 450 | 1.00 | 110 |
| Comp.Ex. 4 | 810 | 0.81 | 7 | 560 | 0.66 | 12 |
| Comp.Ex. 5 | 835 | 0.95 | 6 | 610 | 0.80 | 92 |
| Comp.Ex. 6 | 775 | 0.90 | 13 | 525 | 0.76 | 99 |
| Comp.Ex. 7 | 810 | 0.81 | 6 | 560 | 0.65 | 12 |
| Comp.Ex. 8 | 835 | 0.95 | 6 | 605 | 0.80 | 89 |
| Comp.Ex. 9 | 770 | 0.90 | 13 | 525 | 0.76 | 96 |
| Comp.Ex.10 | 810 | 0.33 | 10 | 760 | 0.42 | 26 |
| Comp.Ex.11 | 795 | 0.35 | 16 | 745 | 0.46 | 41 |
| Comp.Ex.12 | 805 | 0.38 | 18 | 755 | 0.50 | 45 |
| Comp.Ex.13 | 795 | 0.26 | 10 | 700 | 0.26 | 12 |
| Comp.Ex.14 | 795 | 0.27 | 11 | 680 | 0.26 | 13 |
| Comp.Ex.15 | 795 | 0.24 | 10 | 670 | 0.24 | 10 |
| Comp.Ex.16 | 790 | 0.24 | 10 | 700 | 0.24 | 10 |
| Comp.Ex.17 | 780 | 0.24 | 9 | 670 | 0.24 | 9 |
| Comp.Ex.18 | 770 | 0.24 | 8 | 570 | 0.24 | 8 |
| Comp.Ex.19 | 815 | 0.33 | 11 | 760 | 0.42 | 27 |
| Comp.Ex.20 | 790 | 0.35 | 16 | 745 | 0.46 | 41 |
| Comp.Ex.21 | 815 | 0.39 | 19 | 760 | 0.51 | 48 |
| Comp.Ex.22 | 795 | 0.26 | 10 | 700 | 0.26 | 12 |
| Comp.Ex.23 | 795 | 0.27 | 11 | 670 | 0.26 | 13 |
| Comp.Ex.24 | 795 | 0.24 | 10 | 665 | 0.24 | 10 |
| Comp.Ex.25 | 790 | 0.24 | 10 | 700 | 0.24 | 10 |
| Comp.Ex.26 | 780 | 0.24 | 8 | 670 | 0.24 | 9 |
| Comp.Ex.27 | 765 | 0.24 | 7 | 560 | 0.24 | 8 |

Evaluation tests for electrostatic sensitivity stability under various environmental conditions and adhesion were carried as follows.

Electrostatic Sensitivity Stability

As a parameter for the stability, difference between two measured E1/5 values was obtained as $\Delta E1/5 = E1/5$(at 25° C. temperature and 60% relative humidity) −

$\Delta E1/5 = E1/5$(at 10° C. temperature and 15% relative humidity).

Adhesion

The measurement according to the cross cut method defined by JIS G0202 was carried out for the adhesion test for the photoconductor including the charge transport, charge transport, and intermediate layers. In the method, the coated film photoconductor was cut into square sections of 10 mm by 10 mm and then observed how much proportion of these squares of the overlying coated photoconductor film remained without being peeled off by a pulling force of the same degree of strength by a piece of cellophane tape placed on the film.

The results of the evaluation tests are shown in Table 4.

TABLE 4

| | ΔE1/5 | Adhesion |
|---|---|---|
| Ex. 1 | 0.05 | 85 |
| Ex. 2 | 0.05 | 85 |
| Ex. 3 | 0.03 | 95 |
| Ex. 4 | 0.03 | 95 |
| Ex. 5 | 0.03 | 95 |
| Ex. 6 | 0.03 | 93 |
| Ex. 7 | 0.03 | 95 |
| Ex. 8 | 0.03 | 95 |
| Ex. 9 | 0.01 | 100 |
| Ex.10 | 0.01 | 100 |
| Ex.11 | 0.05 | 90 |
| Ex.12 | 0.05 | 90 |
| Ex.13 | 0.05 | 87 |
| Ex.14 | 0.05 | 88 |
| Ex.15 | 0.03 | 93 |
| Ex.16 | 0.03 | 92 |
| Ex.17 | 0.03 | 92 |
| Ex.18 | 0.03 | 92 |
| Ex.19 | 0.03 | 91 |
| Ex.20 | 0.03 | 91 |
| Ex.21 | 0.01 | 97 |
| Ex.22 | 0.01 | 98 |
| Comp.Ex. 1 | 0.05 | 0 |
| Comp.Ex. 2 | 0.05 | 5 |
| Comp.Ex. 3 | 0.06 | 10 |
| Comp.Ex. 4 | 0.05 | 5 |
| Comp.Ex. 5 | 0.05 | 12 |
| Comp.Ex. 6 | 0.06 | 17 |
| Comp.Ex. 7 | 0.05 | 0 |
| Comp.Ex. 8 | 0.05 | 10 |
| Comp.Ex. 9 | 0.06 | 15 |
| Comp.Ex.10 | 0.19 | 85 |
| Comp.Ex.11 | 0.13 | 95 |
| Comp.Ex.12 | 0.13 | 93 |
| Comp.Ex.13 | 0.11 | 90 |
| Comp.Ex.14 | 0.13 | 85 |
| Comp.Ex.15 | 0.18 | 10 |
| Comp.Ex.16 | 0.10 | 70 |
| Comp.EX.17 | 0.15 | 60 |
| Comp.Ex.18 | 0.18 | 20 |
| Comp.Ex.19 | 0.18 | 82 |
| Comp.Ex.20 | 0.13 | 90 |
| Comp.Ex.21 | 0.13 | 87 |
| Comp.Ex.22 | 0.10 | 86 |
| Comp.Ex.23 | 0.13 | 80 |
| Comp.Ex.24 | 0.18 | 5 |
| Comp.Ex.25 | 0.10 | 65 |
| Comp.Ex.26 | 0.15 | 57 |
| Comp.Ex.27 | 0.18 | 17 |

Examples 23 through 32 and Comparative Examples 28 through 43

A variety of electrophotographic photoconductors were fabricated by (1) forming an intermediate layer on a cylindrical aluminum supporting substrate of 80 mm in diameter and 359 mm in length, and (2) a charge generation layer was disposed on the intermediate layer and further thereon disposed a charge transport layer in a similar manner to each of the Examples as shown in Table 5. In these Examples, each of the charge generation layers were disposed to have a thickness of 28 microns.

The photoconductors fabricated as above were incorporated into a Ricoh Co digital copy apparatus commercially available as the IMAGIO MF530™ and 50,000 copies were continuously produced at 25° C. temperature and 50% relative humidity using a test chart with 5% of solid black portion. The reproduced image quality was evaluated for each of the first photocopy and a photocopy after 50,000 copy cycles for each of the fabricated photoconductors.

This series of evaluation were carried out after the adjustments, of the charging current and amount of exposed light from a laser diode, were made such that −850V of the surface charging potential and −100V of the potential at light exposed portion were achieved.

Results of the evaluation tests are shown in Table 5.

TABLE 5

| | Photo-conductor layer | Image Quality | |
|---|---|---|---|
| | | At the initial stage | After 50,000 copies |
| Ex. 23 | Ex. 3 | satisfactory | satisfactory |
| Ex. 24 | Ex. 5 | " | " |
| Ex. 25 | Ex. 7 | " | " |
| Ex. 26 | Ex. 9 | " | " |
| Ex. 27 | Ex. 11 | " | " |
| Ex. 28 | Ex. 13 | " | " |
| Ex. 29 | Ex. 15 | " | " |
| Ex. 30 | Ex. 17 | " | " |
| Ex. 31 | Ex. 19 | " | " |
| Ex. 32 | Ex. 21 | " | " |
| Comp.Ex.28 | Comp.Ex. 4 | " | dirty background and black spots |
| Comp.Ex.29 | Comp.Ex. 5 | " | dirty background and black spots |
| Comp.Ex.30 | Comp.Ex. 6 | dirty background | dirty background and black spots |
| Comp.Ex.31 | Comp.Ex. 7 | satisfactory | dirty background and black spots |
| Comp.Ex.32 | Comp.Ex. 8 | " | dirty background and black spots |
| Comp.Ex.33 | Comp.Ex. 9 | dirty background | dirty background and black spots |
| Comp.Ex.34 | Comp.Ex.10 | satisfactory | reduced image density |
| Comp.Ex.35 | Comp.Ex.11 | " | " |
| Comp.Ex.36 | Comp.Ex.12 | " | " |
| Comp.Ex.37 | Comp.Ex.13 | " | black spots |
| Comp.Ex.38 | Comp.Ex.14 | " | " |
| Comp.Ex.39 | Comp.Ex.19 | " | reduced image density |
| Comp.Ex.40 | Comp.Ex.20 | " | " |
| Comp.Ex.41 | Comp.Ex.21 | " | " |
| Comp.Ex.42 | Comp.Ex.22 | " | black spots |
| Comp.Ex.43 | Comp.Ex.23 | " | " |

Dirty background: For at least 0.1 of optical density D.
Reduced image density: For the decrease in $D_{max}$ by at least 0.1.
Black spots: For more than 1 black spot/cm$^2$.

The results described in this disclosure and shown especially in Tables 3 through 5 clearly indicate that electrophotographic photoconductors of the present invention exhibit such characteristics as high sensitivity for longer wavelength light, satisfactory durability for repeated use, being less affected by various environmental conditions. The electrophotographic photoconductors are, therefore, readily utilized in a variety of photographic recording apparatus of high performance and high practical value, using laser diodes as the light source, without appreciable deterioration in light sensitivity, imaging defects such as black spots. In addition, having excellent adhesion among the layers of the photoconductors, the photoconductors can be handled securely without being peeled off, thus enhancing the durability of the photoconductors.

This application is based on Japanese Patent Application 07-264992, filed with the Japanese Patent Office on Sep. 19, 1995, the entire contents of which are hereby incorporated by reference.

Obviously, additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An electrophotographic photoconductor, comprising an electrically conductive supporting substrate, an intermediate layer disposed thereon, a charge generation layer disposed on said intermediate layer, and a charge transport layer disposed on said charge generation layer, wherein the charge generation layer comprises titanyl phthalocyanine pigments dispersed in a binder resin, said titanyl phthalocyanine pigments exhibiting main peaks of x-ray diffraction at least at the Bragg angles $2\theta=9.6°\pm0.2°$ and $27.2°\pm0.2°$ with the Cu K$\alpha$ characteristic radiation (1.54 A) and said binder resin having 33 mole % or more of hydroxy group, and wherein said intermediate layer comprises titanium dioxide and another binder resin, said titanium dioxide having a purity of 99.2% or more by weight.

2. The electrophotographic photoconductor of claim 1, wherein said binder resin, having 33 mole % or more of hydroxy group, comprises butyral resin.

3. The electrophotographic photoconductor of claim 1, wherein said charge transport layer comprises an aminobiphenyl derivative of the formula (I):

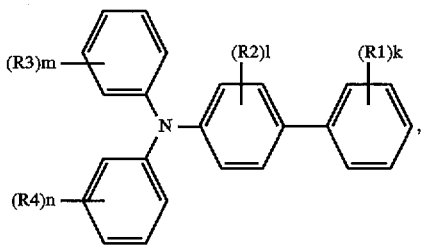

(I)

where R1, R3 and R4 each is hydrogen, an amino group, an alkoxy group, a thioalkoxy group, an aryloxy group, a methylenedioxy group, a substituted or unsubstituted alkyl group, halogen, or a substituted or unsubstituted aryl group; and R2 is hydrogen, an alkoxy group, a substituted or unsubstituted alkyl group, or halogen; R1 and R2 may form a ring compound in combination except where all of R1, R2, R3 and R4 are hydrogen; k, l, m and n each is an integer from 1 to 4; and when k, l, m and n each is 2, 3 or 4, R1, R2, R3 or R4 may be either the same or different.

4. The electrophotographic photoconductor of claim 1, wherein said charge transport layer comprises stilbene compound of the formula (II):

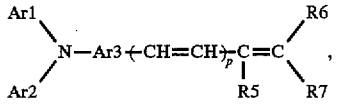

(II)

where Ar1 or Ar2 is a substituted or unsubstituted aryl group or a substituted or unsubstituted heterocyclic group; R5, R6 and R7 each is hydrogen, a substituted or unsubstituted alkyl group, a substituted or unsubstituted alkoxy group, a substituted or unsubstituted aryl group, or a substituted or unsubstituted heterocyclic group; R6 and R7 may form a ring in combination; Ar3 is a substituted or unsubstituted arylene group, and p is an integer of either 0 or 1.

5. The electrophotographic photoconductor of claim 2, wherein said charge transport layer comprises an aminobiphenyl derivative of the formula (I):

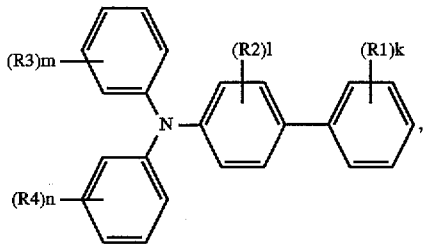

(I)

where R1, R3 and R4 each is hydrogen, an amino group, an alkoxy group, a thioalkoxy group, an aryloxy group, a methylenedioxy group, a substituted or unsubstituted alkyl group, halogen, or a substituted or unsubstituted aryl group; and R2 is hydrogen, an alkoxy group, a substituted or unsubstituted alkyl group, or halogen; R1 and R2 may form a ring compound in combination except where all of R1, R2, R3 and R4 are hydrogen; k, l, m and n each is an integer from 1 to 4; and when k, l, m and n each is 2, 3 or 4, R1, R2, R3 or R4 may be either the same or different.

6. The electrophotographic photoconductor of claim 2, wherein said charge transport layer comprises stilbene compound of the formula (II):

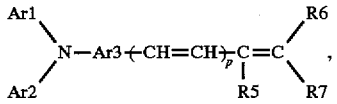

(II)

where Ar1 or Ar2 is a substituted or unsubstituted aryl group or a substituted or unsubstituted heterocyclic group; R5, R6 and R7 each is hydrogen, a substituted or unsubstituted alkyl group, a substituted or unsubstituted alkoxy group, a substituted or unsubstituted aryl group, or a substituted or unsubstituted heterocyclic group; R6 and R7 may form a ring in combination; Ar3 is a substituted or unsubstituted arylene group, and p is an integer of either 0 or 1.

7. The electrophotographic photoconductor of claim 1, wherein said another binder resin of said intermediate layer comprises a melamine resin.

8. The electrophotographic photoconductor of claim 2, wherein said another binder resin of said intermediate layer comprises a melamine resin.

9. The electrophotographic photoconductor of claim 3, wherein said another binder resin of said intermediate layer comprises a melamine resin.

10. The electrophotographic photoconductor of claim 4, wherein said another binder resin of said intermediate layer comprises a melamine resin.

11. The electrophotographic photoconductor of claim 5, wherein said another binder resin of said intermediate layer comprises a melamine resin.

12. The electrophotographic photoconductor of claim 6, wherein said another binder resin of said intermediate layer comprises a melamine resin.

13. The electrophotographic photoconductor of claim 1, additionally comprising a protective layer disposed on said charge transport layer.

14. The electrophotographic photoconductor of claim 13, additionally comprising an intermediate layer between said charge transport layer and said protective layer.

15. The electrophotographic photoconductor of claim 1, wherein said charge transport layer comprises a compound of the formula (III):

(III)

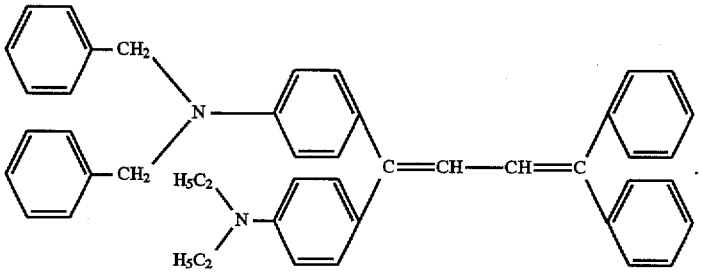

16. The electrophotographic photoconductor of claim 3, wherein R1 is 4-$C_2H_5$, R2 is H, R3 is 4-$CH_3$ and R4 is 4-$CH_3$.

17. The electrophotographic photoconductor of claim 3, wherein R1 is 4-$OCH_3$, R2 is H, R3 is 4-$CH_3$ and R4 is H.

18. The electrophotographic photoconductor of claim 3, wherein R1 is 4-$OC_2H_5$, R2 is H, R3 is 3-$CH_3$ and R4 is 3-$CH_3$.

19. The electrophotographic photoconductor of claim 2, wherein said charge transport layer comprises a compound of the formula (III):

(III)

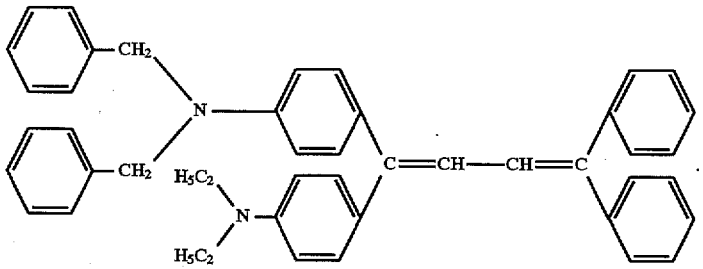

20. The electrophotographic photoconductor of claim 7, wherein said charge transport layer comprises a compound of the formula (III):

(III)

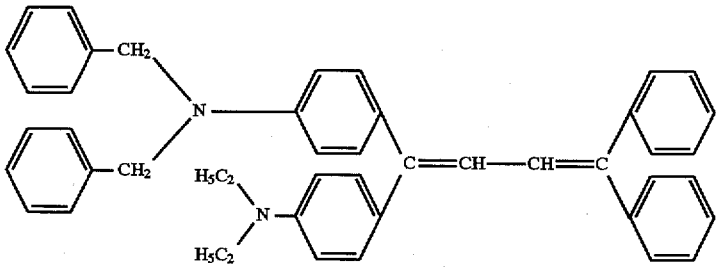

* * * * *